US008246159B2

(12) United States Patent
Ota

(10) Patent No.: US 8,246,159 B2
(45) Date of Patent: Aug. 21, 2012

(54) INK-JET PRINTING PLATEN, AND INK-JET PRINTING DEVICE

(75) Inventor: Yasuhira Ota, Yatomi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1241 days.

(21) Appl. No.: 12/021,518

(22) Filed: Jan. 29, 2008

(65) Prior Publication Data

US 2008/0180508 A1 Jul. 31, 2008

(30) Foreign Application Priority Data

Jan. 30, 2007 (JP) ..... 2007-019454

(51) Int. Cl.
*B41J 2/01* (2006.01)
*B41J 29/13* (2006.01)

(52) U.S. Cl. ..... 347/104; 347/108

(58) Field of Classification Search ..... None
See application file for complete search history.

(56) References Cited

U.S. PATENT DOCUMENTS

| | | | |
|---|---|---|---|
| 6,805,436 | B2 | 10/2004 | Ujita et al. |
| 2004/0155920 | A1 | 8/2004 | Umeda et al. |
| 2006/0023052 | A1 | 2/2006 | Watanabe et al. |
| 2006/0170749 | A1* | 8/2006 | Watanabe ..... 347/104 |

FOREIGN PATENT DOCUMENTS

| | | | |
|---|---|---|---|
| JP | 2003-039753 | A | 2/2003 |
| JP | 2003200587 | A | 7/2003 |
| JP | 2004-058417 | A | 2/2004 |
| JP | 2005283959 | A | 10/2005 |
| JP | 2006035685 | A | 2/2006 |
| JP | 2006205697 | A | 8/2006 |
| JP | 2006224505 | A | 8/2006 |

OTHER PUBLICATIONS

Japan Patent Office, Notification of Reason for Refusal for Japanese Patent Application No. 2007-019454 (counterpart to above-captioned patent application), dispatched Jun. 7, 2011.

* cited by examiner

*Primary Examiner* — Matthew Luu
*Assistant Examiner* — Kendrick Liu
(74) *Attorney, Agent, or Firm* — Baker Botts L.L.P.

(57) ABSTRACT

An ink-jet printing platen provided in an ink-jet printing device operable to eject droplets of an ink toward a surface of a recording medium for thereby performing a printing operation on the recording medium, the ink-jet printing platen being disposed to support the recording medium in an upward direction, the ink-jet printing platen including a main body having at least one groove through which the ink can flow, and at least one elongate member each accommodated in the corresponding groove and extending along the corresponding groove, wherein the main body has an inner surface which defines the corresponding groove and cooperates with the corresponding elongate member, to define therebetween a gap extending in a longitudinal direction of the corresponding groove.

18 Claims, 25 Drawing Sheets

INK-JET PRINTING PLATEN, AND INK-JET PRINTING DEVICE

CROSS REFERENCE TO RELATED APPLICATION

The present application claims the priority from Japanese Patent Application No. 2007-019454 filed Jan. 30, 2007, the disclosure of which is herein incorporated by reference in its entirety.

BACKGROUND OF THE INVENTION

1. Field of the Invention

The present invention relates in general to an ink-jet printing device, and more particularly to a platen of the ink-jet printing device.

2. Description of Related Art

The ink-jet printing device includes a printing head having nozzles through which droplets of an ink are selectively ejected toward a recording medium such as a sheet of paper, to print desired characters or any other images on the recording medium. The ink-jet printing device further includes an inkjet printing platen (hereinafter referred to simply as "platen", where appropriate) which is disposed in an opposed relationship with the printing head, to support the recording medium such that the recording medium faces the printing head. In operation of the ink-jet printing device, the printing head ejects the ink droplets from the selected nozzles while the printing head is reciprocated in the width direction of the recording medium.

The ink-jet printing device may be operated to perform a so-called "non-margin printing operation" on a photographic sheet or postcard. In the non-margin printing operation, an image is printed on the recording medium, without a margin left along an edge of the recording medium. For example, an image is printed over the entire length of the recording medium, without the top and bottom margins left along the leading and trailing edges of the recording surface of the recording medium. In this non-margin printing operation, the ink droplets are ejected from the printing head toward not only the edge portions of the recording medium, but also areas outside the recording surface of the recording medium, so that the ink droplets are deposited on areas of the upper surface of the platen which are outside the recording medium, for instance, which are ahead of the leading edge of the recording medium and behind the trailing edge of the recording medium. The ink droplets deposited on the platen may cause contamination of the back surface of the following recording medium which is fed next onto the platen.

As one solution to the above-indicated problem of contamination of the recording medium with the ink droplets deposited on the platen, JP-2006-205697A discloses a platen that is provided with an ink-receiver portion in the form of a succession of V-grooves formed in its upper surface. The V-grooves permit the ink deposited on the platen to flow to a desired location, owing to a capillarity action and/or an effect of inclination of the V-grooves. For instance, the V-grooves communicate with an ink absorbing member so that the ink flows through the V-grooves to the ink absorbing member and is absorbed into the ink absorbing member, whereby the ink deposited on the platen can be removed from the platen.

JP-2006-224505A discloses a platen having contact members each of which is held in contact with inner surfaces of the corresponding one of grooves formed in the upper surface of the platen, such that the contact member and the groove cooperate to define a predetermined gap serving as an ink flow passage through which an ink deposited on the platen is discharged from the platen, owing to the capillarity action of the ink flow passage.

JP-2003-200587A discloses an ink-jet printing device provided with an ink reservoir in which a plurality of thin sheets are arranged in a spaced-apart relation with each other, to define a plurality of ink flow passages, so that an ink in the ink reservoir is directed toward an outlet of the ink reservoir, owing to a capillarity action of the ink flow passages.

JP-2005-283959A discloses an optical fiber array wherein projections are formed between two substrates and optical fibers interposed therebetween, so as to define gaps having a capillarity action.

The amount of ink droplets deposited per unit time on the platen of an inkjet printing device in the non-margin printing operation tends to increase with an increase of the printing speed of the device. Accordingly, it is desired to increase the capacity of the ink-jet printing device to remove the ink deposited on the platen.

It is generally known that the capillarity action of a flow passage increases with a decrease of the cross sectional surface area of the flow passage. For example, the capillarity action of the flow passages between thin sheets disclosed in JP-2003-200587A and the gaps defined by the projections disclosed in JP-2005-283959A increases with an increase of the cross sectional surface areas of the flow passages and gaps. Therefore, the capillarity action of the V-grooves disclosed in JP-2006-205697A can be increased by either reducing the width of the V-grooves, or increasing the depth of the V-grooves to reduce the angle of the V-grooves.

However, the reduction of the width of the V-grooves makes it difficult to form the platen, and reduces the amount of ink that can be temporarily accommodated in the V-grooves, giving rise to a risk of overflow of the ink. On the other hand, the increase of the depth of the V-grooves results in an increase of a distance between the printing head to the bottom of the V-grooves, giving rise to a risk of a failure of the ink droplets to be introduced into the V-grooves, with a result of floating and misting of the ink droplets. The ink mist tends to adhere to the components built in the ink-jet printing device, and to the recording medium on which a printing operation is to be performed, so that the quality of printing may be deteriorated, and the components of the device may be contaminated with the ink.

SUMMARY OF THE INVENTION

The present invention was made in view of the background art described above. It is therefore a first object of the present invention to provide a platen of an ink-jet printing device, which has means suitable for promoting a flow of an ink through grooves formed in the platen. A second object of the invention is to provide an inkjet printing device having such a platen.

The first object indicated above can be achieved according to any one of the following modes of a first aspect of the present invention, each of which is numbered like the appended claims and depends from the other mode or modes, where appropriate, for easier understanding of technical features disclosed in the present application, and possible combinations of those features. However, it is to be understood that the present invention is not limited to those technical features or combinations thereof, and that the following modes of the invention shall be interpreted in light of the descriptions relating to each mode, the description of preferred embodiments of the invention and the description of the related art. It is to be further understood that any one of the following modes may be combined with a technical feature or features of the other mode or modes, any one of the technical features of any mode may be eliminated, as long as the combination or the elimination follows the above-indicated interpretation of the following modes of the invention.

(1) An ink-jet printing platen provided in an ink-jet printing device operable to eject droplets of an ink toward a surface of a recording medium for thereby performing a printing operation on the recording medium, the ink-jet printing platen being disposed to support the recording medium in an upward direction, the ink-jet printing platen comprising (a) a main body having at least one groove through which the ink can flow, and (b) at least one elongate member each accommodated in a corresponding one of the at least one groove and extending along the corresponding groove, wherein the main body has an inner surface which defines the corresponding groove and cooperates with the corresponding elongate member to define therebetween a gap extending in a longitudinal direction of the corresponding groove.

The ink-jet printing platen constructed according to the above-described mode (1) of this invention is disposed in an opposed relationship with a printing head of the ink-jet printing device, and serves to support the recording medium, and the printing head is operable to eject the ink droplets onto the recording medium supported by the ink-jet printing platen. The ejected ink droplets are ejected at selected spots on the recording medium, so that a desired image such as an image consisting of characters is printed on the recording medium.

The ink droplets ejected from the printing head are deposited in areas of the ink-jet printing platen, which are outside the edges of the recording medium in some printing mode or under some printing condition, for example, in a non-margin printing mode or in the event of abnormal feeding of the recording medium. In this case, the ejected ink droplets are deposited on an upper surface of the elongate member accommodated in the corresponding groove, and on parts of an upper surface of the main body of the platen which parts are not covered by the bar-like member. The elongate member accommodated in the corresponding groove substantially functions to reduce an effective depth of the groove, so that a distance of movement of the ink droplets in the air from the printing head and the ink-jet printing platen is made shorter than where the elongate member is not provided, making it possible to prevent the ink droplets from changing into an ink mist after the ink droplets are ejected from the printing head. The ink droplets deposited on the upper surface of the elongate member and the upper surface of the main body rapidly flow into the gaps defined by the inner surfaces of the main body and outer surfaces of the elongate member, owing to the capillarity force and the gravity. Thus, the ink droplets do not stay on the upper surfaces of the elongate member and the main body, for a long time.

(2) The ink-jet printing platen according to the above-described mode (1), comprising at least one of the following technical features: each of the at least one groove being formed such that groove has a height smaller at one end thereof than at the other end; the gap being shaped such that a capillarity force acting on the ink existing in the gap increases in a direction from the above-indicated one end toward the other end; and the groove being held at the above-indicated one end in contact with an ink absorber which absorbs the ink.

The ink which has flown into the gaps moves toward the above-indicated one end of the groove, where the groove is closed at the other end, even in the absence of any one of the above-described three technical or structural features. However, the movement of the ink toward the above-indicated one end through the gaps is promoted where the ink-jet printing platen comprises at least one of the three technical features.

(3) The ink-jet printing platen according to the above-described mode (1) or (2), wherein the inner surface of the main body comprises a pair of inner side surfaces opposed to each other, and each of the at least one elongate member has a pair of outer side surfaces which are held in an opposed relationship with the pair of inner side surfaces, respectively, to define the gap including (i) at least one pair of first flow passages extending in a direction of depth of the corresponding groove, and (ii) a second flow passage extending in a direction of extension of the corresponding groove.

The ink deposited on the elongate member first flow through the first flow passages in the direction of depth of the groove, into the second flow passage, and then the ink flows through the second flow passage in the direction of extension of the groove. In the presence of the elongate member within the corresponding groove, the transverse cross sectional surface area of the groove can be reduced to increase the capillarity action of the groove.

(4) The ink-jet printing platen according to the above-described mode (3), wherein the second flow passage has a surface area as viewed in a transverse cross sectional plane perpendicular to a direction of flow of the ink through the second flow passage, which surface area gradually decreases as the second flow passage extends in the direction of flow of the ink.

(5) The ink-jet printing platen according to the above-described mode (4), wherein each of the at least one elongate member has a surface area as viewed in the transverse cross sectional plane, which surface area gradually increases as the elongate member extends in the direction of extension of the corresponding groove, whereby the surface area of the second flow passage gradually decreases as the second flow passage extends in the direction of flow of the ink.

(6) The ink-jet printing platen according to any one of the above-described modes (3)-(5), wherein each of the at least one grooves has a depth which gradually increases as the groove extends in a direction of flow of the ink through the second flow passage.

(7) The ink-jet printing platen according to any one of the above-described modes (3)-(6), wherein each of the plurality of grooves is V-shaped as viewed in a transverse cross sectional plane perpendicular to a direction of flow of the ink through the groove.

(8) The ink-jet printing platen according to any one of the above-described modes (3)-(7), wherein each of the at least one elongate member has a pair of slant surfaces which are inclined downwards toward the first flow passages, respectively.

(9) The ink-jet printing platen according to any one of the above-described modes (3)-(8), further comprising an ink absorber disposed on a downstream side of the corresponding groove as viewed in a direction of flow of the ink through the second flow passage, the ink absorber absorbing and retaining the ink therein.

(10) The ink-jet printing platen according to any one of the above-described modes (3)-(9), wherein the at least one groove consists of a plurality of grooves which are arranged in a direction perpendicular to the direction of extension of the grooves, and the at least one elongate member consists of a plurality of grooves which are accommodated in the respective grooves

(11) The ink-jet printing platen according to any one of the above-described modes (1)-(10), having two upwardly projecting medium-support portions which are disposed on respective opposite sides of the corresponding groove as viewed in a direction of extension of the groove.

(12) The ink-jet printing platen according to the above-described mode (11), further comprising a covering member covering at least a part of the main body, and wherein the main body has one of the two upwardly projecting medium-support portions, while the covering member has the other of the two upwardly projecting medium-support portions.

(13) The ink-jet printing platen according to the above-described mode (12), wherein one of the two upwardly projecting medium-support portions includes a plurality of ribs arranged in a direction perpendicular to the direction of extension of the corresponding groove, while the other of the two upwardly projecting medium-support portions includes a projection extending in the direction perpendicular to the direction of extension of the corresponding groove.

(14) The ink-jet printing platen according to any one of the above-described modes (1)-(13), further comprising a covering member covering at least a part of the main body, and wherein the covering member has the at least one elongate member.

(15) The ink-jet printing platen according to the above-described mode (14), wherein the at least one groove consists of a plurality of grooves, and the at least one elongate member consists of a plurality of elongate members accommodated in the respective grooves, the covering member including a covering portion covering the main body, and a comb portion having the plurality of elongate members formed in a comb pattern.

(16) The ink-jet printing platen according to any one of the above-described modes (1)-(15), wherein the second flow passage is partially defined by a pair of inner side surfaces, and a bottom surface having a height which gradually increases in the direction of extension of the corresponding groove.

(17) The ink-jet printing platen according to any one of the above-described modes (3)-(16), wherein each of the at least one elongate member has protrusions which extend from opposite inner side surfaces thereof and which are spaced from each other in a direction of extension of the elongate member, the protrusions being held in contact with the inner side surfaces of the corresponding groove such that the elongate member is positioned in place within the corresponding groove, so as to define the first and second flow passages.

(18) The ink-jet printing platen according to claim 3, wherein each of the at least one elongate member has recesses formed in two opposite inner side surfaces thereof which are spaced from each other arranged in a direction of extension of the elongate member, the recesses being held in contact with the side surfaces such that the elongate member is positioned in place within the corresponding groove and such that the side surfaces cooperate with the recesses to define the first flow passages.

The second object can be achieved according to a second aspect of this invention, which provides an ink-jet printing device comprising (a) an ink-jet printing platen constructed according to any one of the above-described modes (1)-(18), (b) a feeding mechanism for feeding a recording medium onto the ink-jet printing platen, and (c) a printing head disposed in an opposed relationship with the ink-jet printing platen, and configured to eject droplets of an ink.

According to the present invention droplets of the ink ejected into the grooves formed in the main body of the ink-jet printing platen are deposited on the elongate members, and the distance between the printing head and the elongate members can be adjusted, irrespective of the depth of the grooves, so as to prevent or reduce generation of an ink mist due to the ink droplets.

Further, surface area of the first and second flow passages in planes parallel to the directions of flow of the ink therethrough can be adjusted by adjusting the sizes of gaps between the side surfaces of the grooves and the elongate members, so that the capillarity actions of the first and second flow passages can be increased by reducing the cross sectional surface areas of the first and second flow passages.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which.

DETAILED DESCRIPTION OF THE PREFERRED EMBODIMENTS

Figure 1:
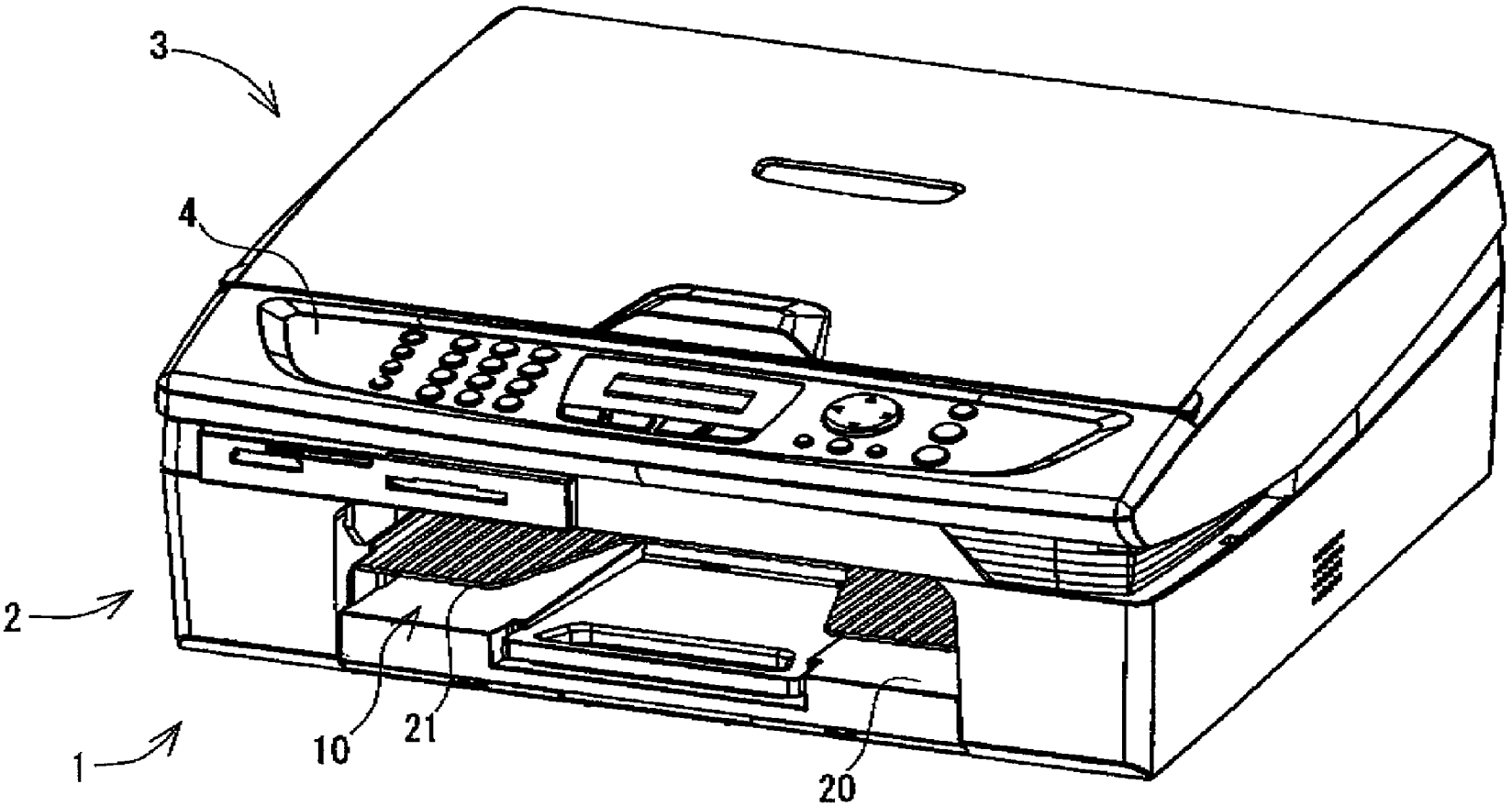
FIG. 1 is a perspective view showing an overall external appearance of a multi-function device 1 serving as an ink-jet printing device constructed according to one embodiment of the present invention.

Referring to the drawings, the preferred embodiments of this invention will be described in detail. It is to be understood that the following preferred embodiments are given for illustrative purpose only, and may be modified as needed, without departing from the spirit of the present invention.

First Embodiment

Referring first to the perspective view of FIG. 1, there is shown a multi-function device (MFD) 1 serving as an ink-jet printing device constructed according to a first embodiment of the present invention. The multi-function device 1 includes a printer portion 2 and a scanner portion 3 incorporated therein, and has a printing function, a scanning function, a copying function and facsimile transmission/reception function. The printer portion 2 and the scanner portion 3 are built in respective lower and upper parts of the multifunction device 1. The ink-jet printing device is constituted principally by the printer portion 2. Namely, the scanner portion 3, which is not a part of the ink-jet printing device of the present invention, does not directly relate to the concept of the invention, and will not be described in detail.

The printer portion 2 is configured to be operable to print an image or a text of a document on a recording medium such as a sheet of paper, according to image data read by the scanner portion 3 or printing data received from an external device. The printer portion 2 has an opening 10 open on its front side, and a sheet supply tray 20 and an ejected-sheet tray 21 at least partially accommodated in the opening 10.

The multi-function device 1 has an operator's control panel 4 in a front upper portion of its housing. The operator's control panel 4 includes various keys and a liquid crystal display. The multi-function device 1 is operated according to command signals that are input through the operator's control panel 4 or from an external computer through a printer driver or a scanner driver. For instance, the operator's control panel 4 is used to select one of a margin printing mode and a non-margin printing mode of the printer portion 2.

There will be described components of the ink-jet printing device in the form of the printer portion 2, by reference to the elevational view in transverse cross section. It is noted that FIG. 2 does not show the housing and scanner portion 3 of the multi-function device 1.

The sheet supply tray 20 and the ejected-sheet tray 21 are disposed such that the ejected-sheet tray 21 is located above the sheet supply tray 20. The sheet supply tray 20 accommodates a stack of recording media such as sheets of paper, OHP (overhead projector) sheets or other resin sheets, and compact discs or other optical discs. The ejected-sheet tray 21 is provided to hold the recording media on which an ink-jet printing operation has been performed by the printer portion 2. The sheet supply tray 20 and ejected-sheet tray 21 can accommodate various sizes of the recording media, such as A4 size, B5 size and postcard size.

Behind the sheet supply tray 20, there is disposed a separating plate 22 which has an inner surface with which the recording medium (hereinafter referred to as "paper sheet", where appropriate) comes into abutting contact. This inner surface extends almost upright toward an upper part of the printer portion 2, and is formed with saw-tooth projections extending on the side of the recording medium. These saw-tooth projections facilitate separation of the paper sheets fed from the sheet supply tray 20 one after another so that the paper sheets are guided into a feed path 23 in a spaced-apart relation with each other.

The feed path 23 is defined by the separating plate 22, a supply roller 25, an ejector roller 48, etc., which cooperate with each other to constitute a major portion of a feeding mechanism of the ink-jet printing device. The feed path 23 extends upwards from the upper end of the separating plate 22, further extends almost horizontally toward the ejected-sheet tray 21 on the front side of the multi-function device 1. On an upstream side of the ejected-sheet tray 21 as viewed in the feeding direction of the paper sheet there is disposed an image-forming unit 24. The paper sheet supplied from the sheet supply tray 20 is guided along the feed path 23 along a U-curve from the lower part toward the upper part of the printer portion 2, and is thereby fed through the image-forming unit 24. While the paper sheet is fed through the feed path 23, the image-forming unit 24 is operated to perform an ink-jet printing operation on the paper sheet. The paper sheet on which the ink-jet printing operation has been performed is ejected onto the ejected-sheet tray 21.

The supply roller 25 is disposed in opposition with the sheet supply tray 20, and is rotatably supported at the free end portion of a swing arm 26, which is pivotable about a shaft 30 so that the supply roller 25 is vertically movable toward and away from the sheet supply tray 20 installed in its operating position.

The swing arm 26 is biased downwards toward the sheet supply tray 20, by gravity or suitable biasing means such as a spring. When the sheet supply tray 20 is inserted into its operating positions the swing arm 26 is pivoted upwards, with the suppler roller 25 held in contact with the top of a stack of paper sheets accommodated in the sheet supply tray 20, that is, with the uppermost paper sheet of the stack. When the sheet supply tray 20 is removed from its operating position, the swing arm 26 is pivoted downwards to its lowermost position.

Figure 2:
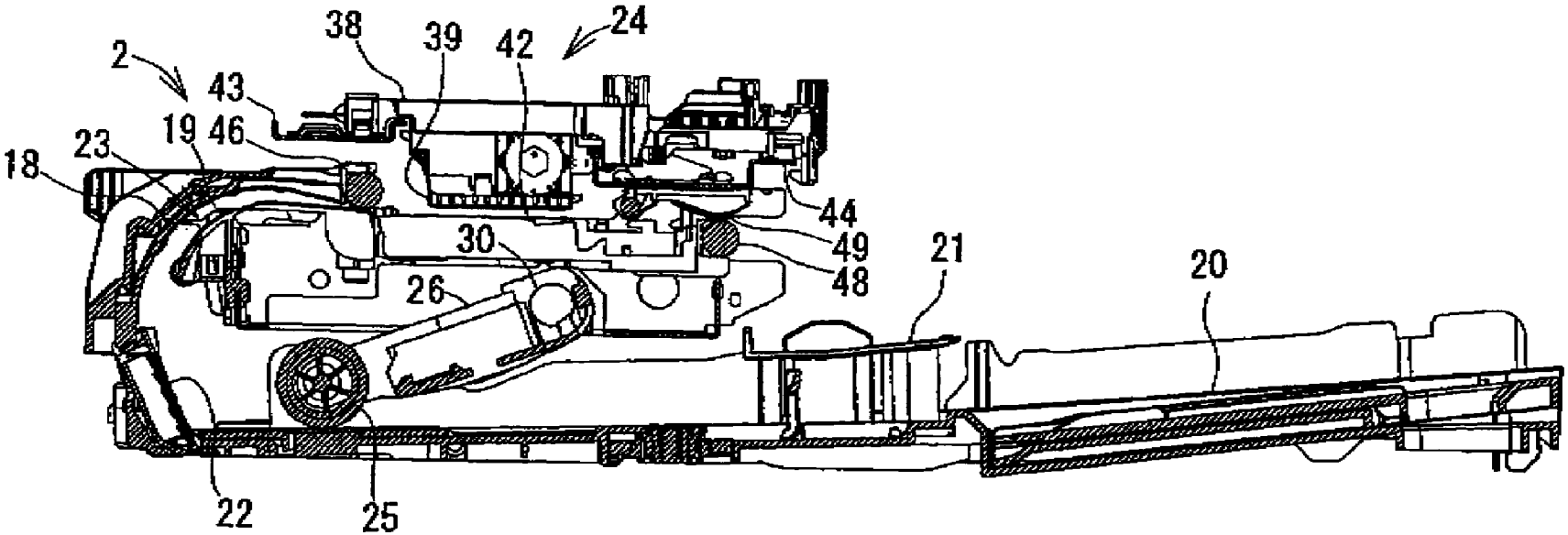
FIG. 2 is an elevational view in transverse cross section of q printer portion 2 of the multifunction device 1 of FIG. 1.

The supply roller 25 is rotated by a line feed motor (LF motor not shown in FIG. 2). The sheets of paper are fed out one after another from the sheet supply tray 20 toward the separating plate 22, by a rotary motion of the supply roller 25, and are guided along the feed path 23.

The feed path 23 is defined by an outer guide surface and a lower guide surface, except in its portion in which the image-forming unit 24 is disposed. The outer and inner guide surfaces are spaced apart from each other by a suitable distance. For instance, the U-curved portion of the feed path 23 on the rear side of the multi-function device 1 is defined by outer and inner guide members 18, 19 which are fixed to the housing of the device 1 such that the respective outer and inner guide surfaces are spaced apart from each other by the suitable distance as shown in FIG. 2.

The image-forming unit 24 is located on the downstream side of the U-curved portion of the feed path 23, as viewed in the feeding direction of the paper sheets. The image-forming unit 24 includes a carriage 38 which carries the printing head 39 and which is reciprocable in a direction perpendicular to the direction of feeding of the paper sheets along an upper surface of a platen 42. That is, the reciprocating direction of the carriage 38 is normal to the plane of FIG. 2.

The printing head 39 is supplied with cyan (C), magenta (M) yellow (Y) and black (Bk) inks fed from respective ink cartridges (not shown in FIG. 2) through respective ink tubes. Each of the ink cartridges is installed in the multi-function device 1, at a suitable position outside the printing head 39. In a printing operation of the printing head 39 while the carriage 38 is reciprocated, droplets of inks of the different colors are ejected from the selected nozzles to print an image on the recording medium being supported by the platen 42 in an upward direction. The ejection of the ink droplets from the printing head 39 is controlled according to a selected one of printing modes and a selected size of the paper sheets, for example. In the non-margin printing mode, for instance, the ink droplets are ejected from the nozzles opposed to an ink absorber 53 of the platen 42, so that the ejected ink droplets are deposited on areas of the platen 42 which corresponds to the ink absorber 53 and which are outside the edges of the recording medium.

The carriage 38 is supported by a pair of guide rails 43, 44 which are disposed above the feed path 23 and spaced apart from each other in the feeding direction of the paper sheets. Namely, the guide rails 43, 44 extend in the reciprocating direction of the carriage 38 perpendicular to the feeding direction of the paper sheets. The carriage 38 straddles on the guide rails 48, 44 such that the carriage 38 is reciprocable slidable on and along the guide rails 43, 44.

The carriage 38 is reciprocated by a carriage drive motor (CR motor not shown in FIG. 2) in the direction of extension of the guide rails 43, 44. The carriage drive motor is operatively connected to the carriage 38 through a belt-drive mechanism (not shown in FIG. 2).

The belt-drive mechanism is a mechanism well known in the art. For example, the belt-drive includes a drive pulley, a driven pulley, and a timing belt which connects the drive and driven pulleys and which is fixed to the carriage 38. The drive pulley is driven by the carriage drive motor, and the timing belt is rotated so that the carriage 38 is reciprocated by the timing belt, slidably on the guide rails 43, 44. As a result, the printing head 39 is reciprocated in the width direction of the paper sheets fed along the feed path 23. The reciprocating motion of the carriage 38 is controlled on the basis of an output signal of a linear encoder.

The platen 42 is disposed below the feed path 23 extending in the direction perpendicular to the reciprocating direction of the printing head 39. The platen 42, which is a preferred embodiment of an ink-jet printing platen of this invention, will be described in detail.

The feed roller 46 is disposed on the upstream side of the image-forming unit 24 such that the feed roller 46 is opposed to a pinch roller (hidden by another component and not shown in FIG. 2). The feed roller 46 cooperates with the pinch roller to pinch and feed the paper sheet along the feed path 23. The feed roller 46 is also driven by the line feed motor.

The above-indicated ejector roller 48 cooperates with another pinch roller to pinch and feed the printed sheet of paper so that the printed paper sheet is ejected onto the ejected-sheet tray 21. The ejector roller 48 is also driven by the line feed motor. The feed roller 46 and the ejector roller 48 are rotated in synchronization with each other. Rotary motions of the feed and ejector rollers 46, 48 are controlled on the basis of an output signal of a rotary encoder.

During the printing operation of the image-forming unit 24, the feed and ejector rollers 46, 48 are intermittently rotated to intermittently feed the paper sheet by a predetermined line feed distance in each of intermittent feeding motions, which corresponds to each printing movement of the carriage 38. The carriage 38 is moved while the feed and ejector rollers 46, 48 are at rest, and the ink droplets are ejected from the selected nozzles of the printing head 39 during the movement of the carriage 38. Most of the ink droplets are ejected onto the recording upper surface of the paper sheet on the platen 42. The movement of the carriage 38 is followed by the next rotary motions of the feed and ejector rollers 46, 48 to feed the paper sheet by the predetermined line feed distance, and the next movement of the carriage 38 to print the next line. These operations of the feed and ejector rollers 46, 48, carriage 38 and printing head 39 are repeatedly performed to print the desired image on the paper sheet.

There will be described in detail the construction of the ink-jet printing platen in the form of the platen 42.

Figure 3:
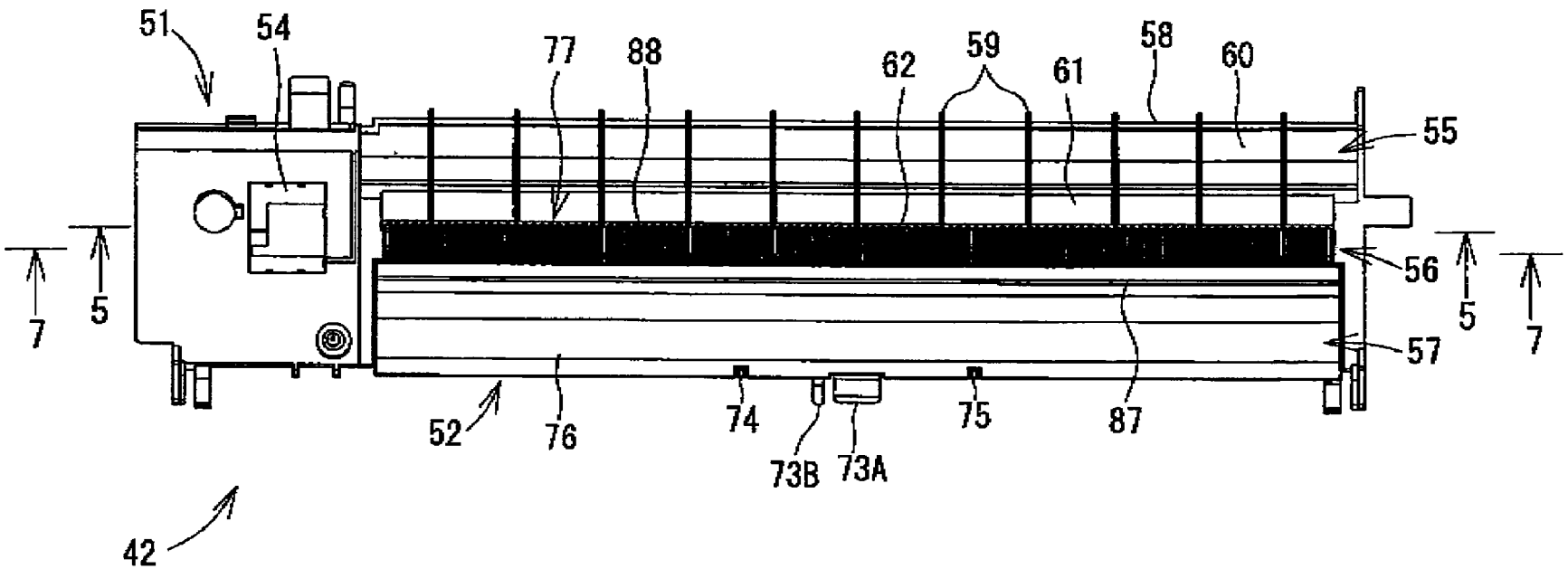
FIG. 3 is a plan view of a platen 42 of the printer portion 2 of FIG. 2.
Figure 4:
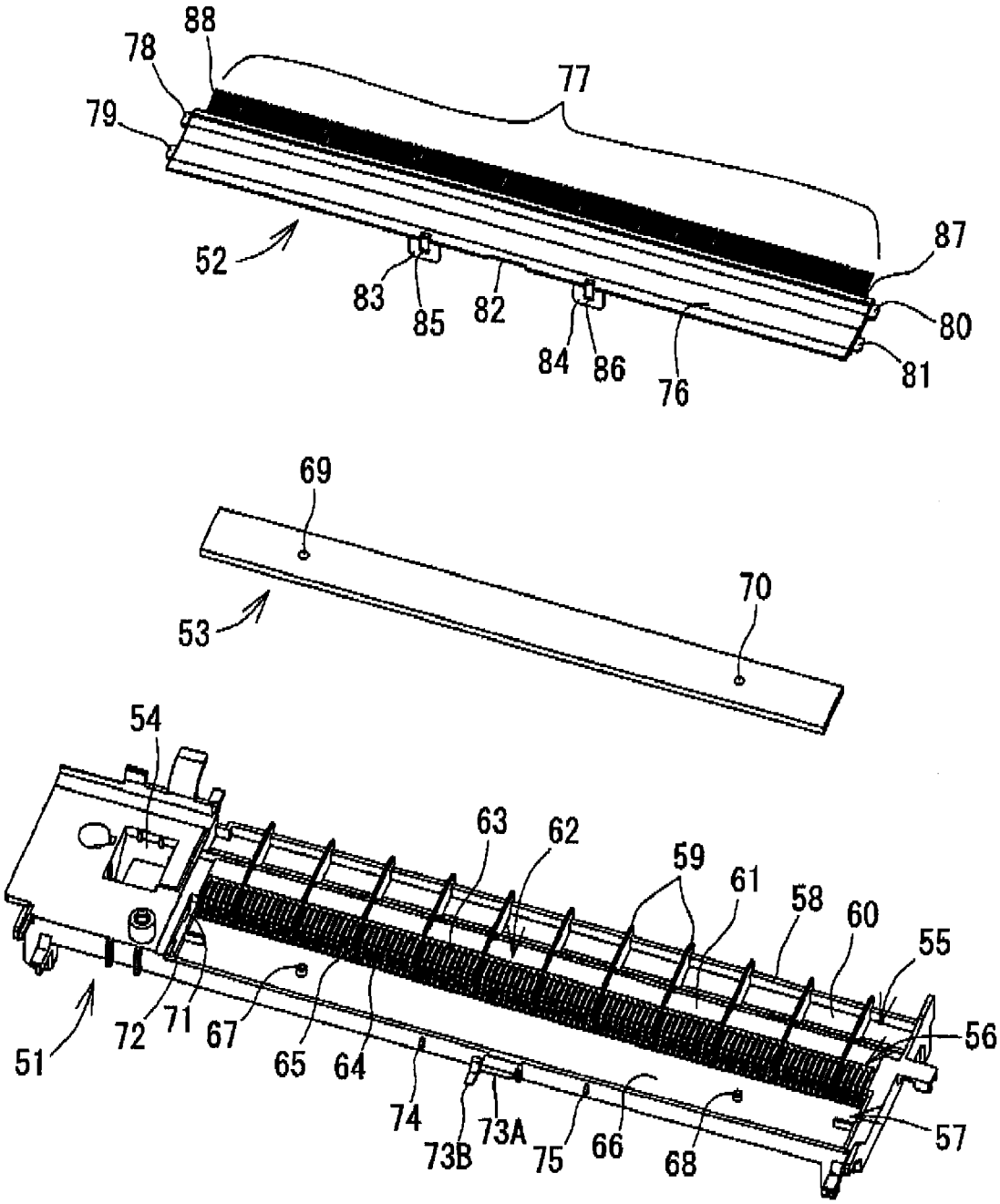
FIG. 4 is an exploded perspective view of the paten 42.
Figure 5:
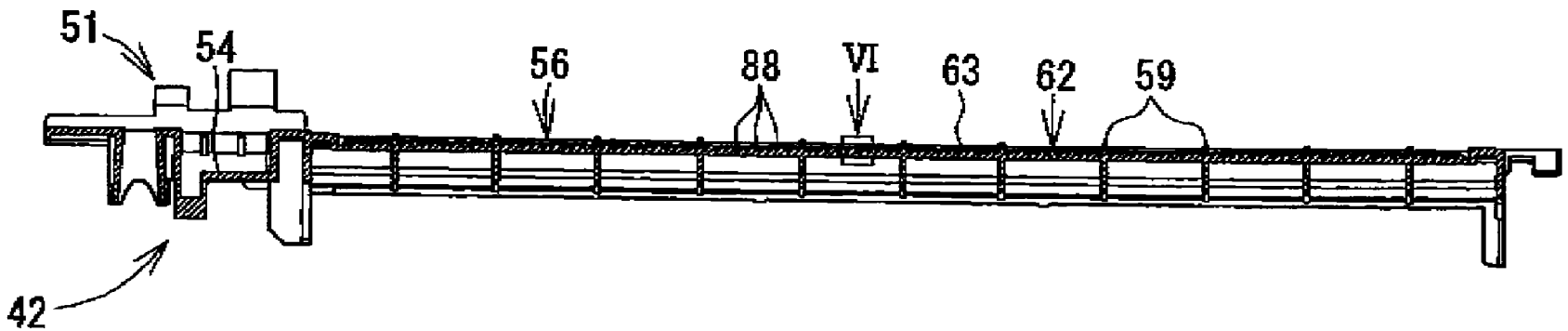
FIG. 5 is a cross sectional view taken along line 5-5 of FIG. 3.
Figure 6:
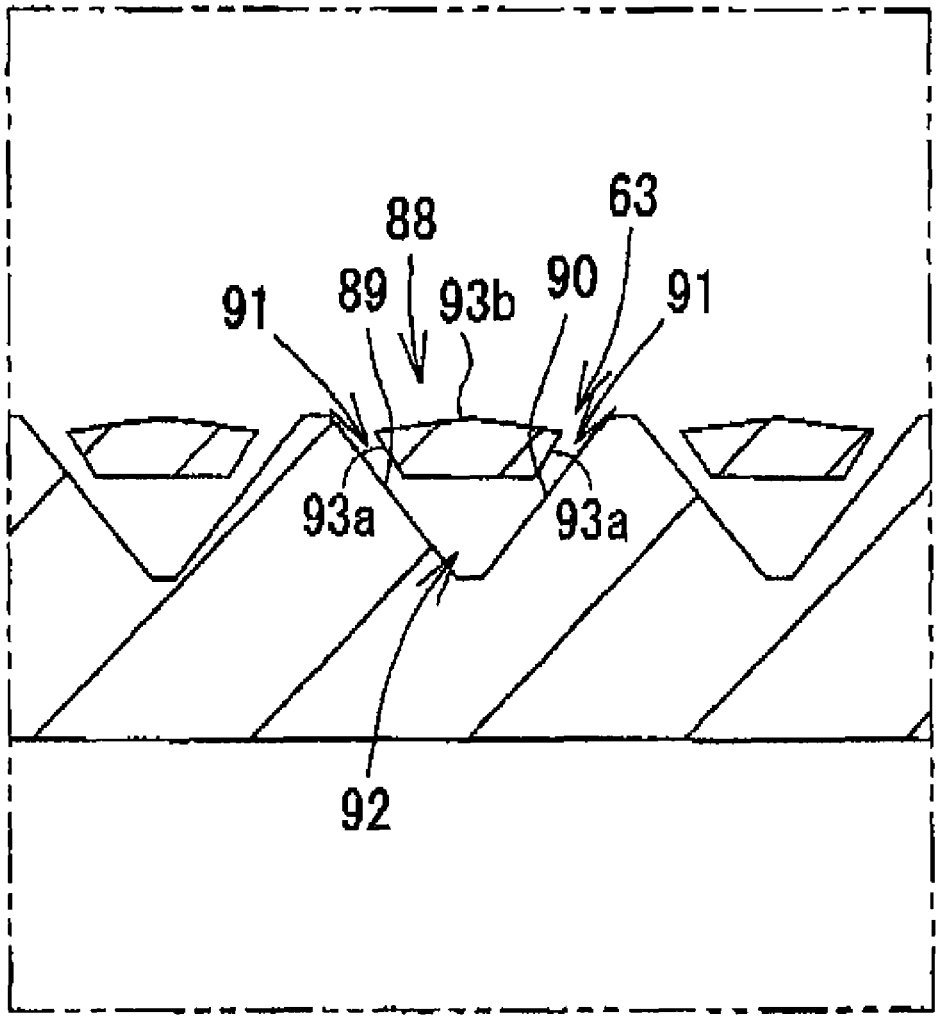
FIG. 6 is an enlarged view of a part VI of the platen 42 indicated in FIG. 5.
Figure 7:
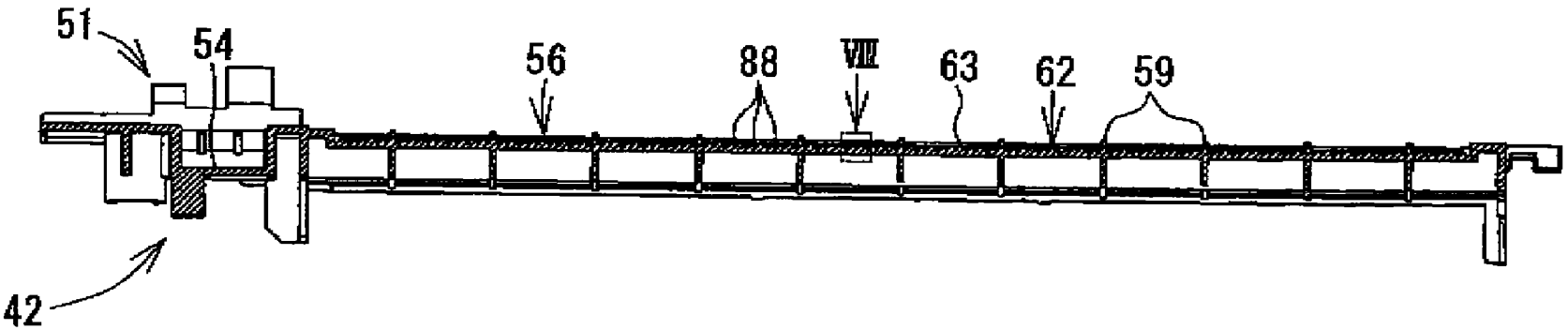
FIG. 7 is a cross sectional view taken along line 7-7 of FIG. 3.
Figure 8:
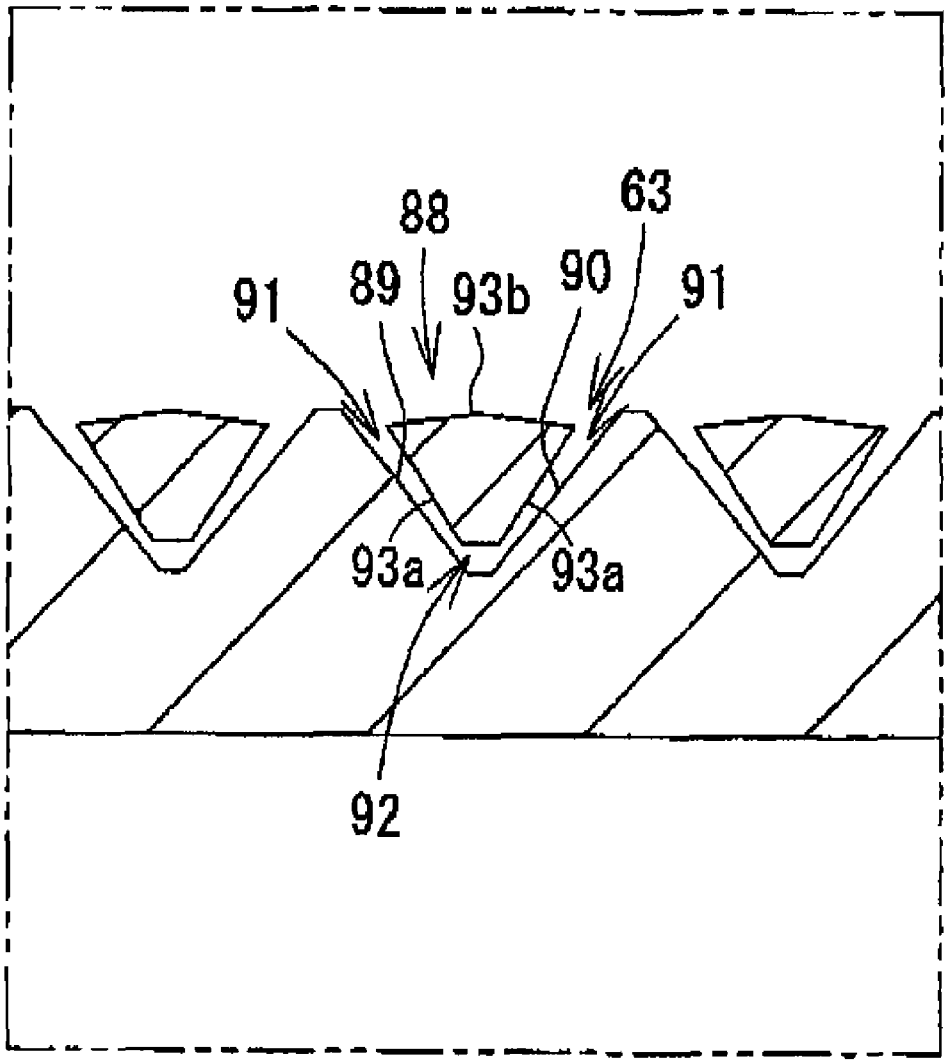
FIG. 8 is an enlarged view of a part VIII of the platen indicated in FIG. 7.

An overall appearance of the platen 42 is shown in a plan view of FIG. 3. FIG. 4 is an exploded perspective view of the paten 42, and FIG. 5 is a cross sectional view taken along line 5-5 of FIG. 3, while FIG. 6 is an enlarged view of a part VI of the platen 42 indicated in FIG. 5. FIG. 7 is a cross sectional view taken along line 7-7 of FIG. 3, while FIG. 8 is an enlarged view of a part VIII of the platen indicated in FIG. 7.

As shown in FIGS. 3 and 4, the platen 42 includes a main body 51 and a covering member 52. The ink absorber 53 indicated above is accommodated in a space formed between the main body 51 and the covering member 52. That is, the platen 42 further includes the ink absorber 53 which absorbs and retains the ink therein. The platen 42 is a generally planar member as a whole, and has a generally rectangular shape as seen in the plan view of FIG. 3 wherein the horizontal direction is the reciprocating direction of the printing head 39, while the vertical direction is the feeding direction of the paper sheets. The horizontal and vertical directions respectively correspond to the longitudinal and transverse (width) direction of the platen 42. The paper sheets are fed in the downward direction as seen in FIG. 3.

The length (longitudinal dimension) of the platen 42 is sufficiently larger than the maximum width of the paper sheet on which the printing operation of the printer portion 2 is possible. Accordingly, the paper sheet of any width not larger than the maximum width can be supported by the platen 42 over its entire width. The platen 42 is provided with a waste-ink reservoir 54 in a left end portion thereof which is not used to support the paper sheets. This waste-ink reservoir 54 is used to store a waste ink produced as a result of flushing and other maintenance operations of the printing head 39, and does not relate to the present invention.

The main body 51 of the platen 42 consists of three major portions, that is, a medium-supporter portion 55 disposed on the upstream side as viewed in the feeding direction of the paper sheets, an ink-receiver portion 56 disposed in an intermediate part as viewed in the sheet feeding direction, and an ink-container portion 57 disposed on the downstream side. The main body 51 consisting of these three major portions 55-57 is a one-piece structure formed of a synthetic resin.

The medium-supporter portion 55 has a base plate 58, and a medium-support portion in the form of a plurality of ribs 59. The base plate 58 includes a lower section 60 disposed on the upstream side as viewed in the sheet feeding direction, and an upper section 61 disposed on the downstream side. The upper surface of the upper section 61 has a larger eight than that of the lower section 60. The ribs 59 project upright from the base plate 58, and in the transverse or width direction of the platen 42 over the lower and upper sections 60, 61. Accordingly, the ribs 59 have top surfaces higher than the upper surfaces of the lower and upper sections 60, 61. The ribs 59 are spaced apart from each other by a predetermined distance in the longitudinal direction of the platen 42. The arrangement of the ribs 59 are determined depending upon the sizes of the recording media used, and the positions of the recording media in the width direction when supported by the platen 42, that is, whether the recording medium in question is located centrally in the width direction an the case of a center registering) or located sideways with respect to the center position (in the case of sideway or offset registering).

The ink-receiver portion 56 has a multiplicity of grooves 62 each of which is V-shaped and open upwards as viewed in the transverse cross sectional plane. The grooves 62 extend in the transverse direction of the main body 51, and have a length equal to a dimension of a rectangular area in which the nozzles from which the ink droplets are ejected only in the non-margin printing mode. The grooves 62 are arranged in a direction perpendicular to the direction of extension, such that the grooves 62 are parallel to each other. The dimension of the above-indicated rectangular area is the dimension in the feeding direction of the paper sheets. Each groove 62 has an upstream end at the downstream end of the upper section 61, as viewed in the sheet feeding direction. The upper surface of the upper section 61 has a larger height than the surface of the ink-receiver portion 56 in which the grooves 62 are formed. Accordingly, the grooves 62 are closed at the upstream ends by the upper section 61. The top surface of each rib 59 has a larger height than the above-indicated surface of the ink-receiver portion 56.

The grooves 62 have downstream ends at the upstream end of the ink-container portion 57. The ink-container portion 57 has a smaller height than the ink-receiver portion 56. In the presence of a difference in height between the ink-receiver portion 56 and the ink-container portion 57, each groove 62 consists of an upper portion 63, an upright portion 64 and a lower portion 65, which are firmed continuously to permit a flow of ink. The configuration of the upper portion 63 will be described in detail. The downstream end of the groove 62 as viewed in the sheet feeding direction, that is, the downstream end of the lower portion 65 is open to the ink-container portion 57, so that the ink flowing through the lower portion 65 can flow onto the ink-container portion 57, The grooves 62 are formed at a predetermined pitch in the longitudinal direction of the main body 51, such that the adjacent two grooves 62 are spaced apart from each other in the above-indicated longitudinal direction by a vertically projecting tooth having an inverted V shape.

The ink-container portion 57 is a container structure which is open upwards and which has a bottom wall 66 having a smaller height than the upper section 63 of the grooves 62. The ink-container portion 57 has a rectangular shape as seen in the plan view of FIG. 3, which corresponds to a rectangular shape of the ink absorber 53. In the present embodiment, the ink absorber 53 is a rectangular parallelepiped. The bottom wall 66 of the container structure of the ink-container portion 57 has an upper surface which has two protrusions 67, 68 formed at positions corresponding to those of two through-holes 69, 70 formed through the ink absorber 53. The ink absorber 53 is positioned in place in the horizontal plane within the ink-container portion 57, with the protrusions 67, 68 inserted in the through-holes 69, 70.

The ink-container portion 57 have two elongate holes 71, 72 formed near the upper end of each of two side walls that are opposed to each other in the longitudinal direction. In FIG. 4, the elongate holes 71, 72 formed in the right side wall are not shown. The downstream end face of the main body 510*k* accommodating portion 57) as viewed in the sheet feeding direction has clips 73A, 73B, and two pawls 74, 75 formed on the respective opposite sides of the clips 73A, 73B. The pawls 74, 75 are provided to fix the covering member 52 to the main body 51 in a predetermined positional relationship therebetween, as described below.

The ink absorber 53 is formed of a material that can absorb and accommodate the ink. For instance, the material is selected from foamed polyurethane and other foamed resins, paper materials, and cloths. The ink absorber 53, which is the rectangular parallelepiped as described above, is accommodated in the recess of the ink-container portion 57, with the protrusions 67, 68 inserted through the through-holes 69, 70 to position the ink absorber 53 in the horizontal plane relative to the ink-container portion 57. The ink absorber 53 thus positioned within the ink-container portion 57 has an upstream end at the downstream end of each groove 62.

The covering member 52 includes a covering portion 76 covering the ink-container portion 57, and a comb portion 77 having a multiplicity of elongate members in the form of bar-like members 88 arranged in a comb-like pattern. The covering member 52 is a one-piece structure formed of a synthetic resin.

The covering portion 76 is a generally rectangular plate having a width dimension which is almost equal to a sum of a dimension of the lower portion 65 of the grooves 62 and a dimension of the ink-container portion 57 as viewed in the sheet feeding direction. The covering portion 76 when the covering member 52 is installed in position on the main body 51 covers the upright portion 64 and lower portion 65 of the grooves 62, and the ink-container portion 57. The covering portion 76 has two elongate lugs 78-81 formed on each of its two longitudinally opposite ends. These elongate lugs 78-81 are inserted in the elongate holes 71, 72 formed in the ink-container portion 57, to fix the covering member 52 to the main body 51 such that the covering member 52 is positioned in the horizontal plane relative to the main body 51.

The covering portion 76 of the covering member 52 has a cutout 82 formed at a longitudinally central position in the downstream end as viewed in the sheet feeding direction. This cutout 82 is open in the sheet feeding direction, and is formed to be engageable with the clip 73A formed on the main body 51. The clips 73A, 73B cooperate to pinch the drive shaft of the ejector roller 48 (FIG. 2), so that the platen 42 is positioned relative to the ejector roller 48. The covering portion 76 also has two downward extensions 83, 84 formed on the respective opposite sides of the cutout 82. These downward extensions 83, 84 have respective through-holes 85, 86 engageable with the pawls 74, 75 formed on the main body 51 to fix the covering member 52 to the main body 51 in a predetermined positional relationship therebetween.

The covering portion 76 has an elongate projection 87 formed adjacent to the comb portion 77. The elongate projection 87 projects upwards from the upper surface of the covering portion 76, and cooperates with the ribs 59 of the medium-supporter portion 55 to function as two upwardly projecting medium-support portions which are disposed to support the recording medium, on respective opposite sides of the grooves 62 as viewed in the direction of extension of the grooves 62. The elongate projection 87 has an inverted-V shape defined by an ascending surface extending in the sheet feeding direction from the comb portion 77, and a descending surface extending from the ascending surface in the sheet feeding direction. The apex of the inversed-V shape of the elongate projection 87 extends in the longitudinal direction of the covering portion 52.

The comb portion 77 includes the multiplicity of bar-like members 88 arranged in the longitudinal direction of the covering portion 76 such that the bar-like members 88 are equally spaced apart from each other by a predetermined spacing distance. That is, the bar-like members 88 corresponding to the respective grooves 62 are arranged in the direction perpendicular to the direction of extension of the grooves 62 such that the bar-like members 88 are parallel to each other. Each of the bar-like members 88 extends from the upstream end of the covering portion 76 in the direction opposite to the sheet feeding direction. The bar-like member 88 has cross sectional dimensions that can be accommodated in the upper portion 63 of the corresponding groove 62, and a length almost equal to the length of the upper portion 63. The comb portion 77 is positioned relative to the covering member 52 such that the bar-like members 88 are accommodated in the upper portions 63 of the respective grooves 62 when the covering member 52 is fixed in position to the main body 51.

There will be described in detail the positional relationship between the upper portion 63 of each groove 62 and the corresponding elongate member in the form of the bar-like member 88, by reference to FIGS. 5-8. As shown in these figures, each bar-like member 88 is accommodated within a space of the upper portion 63 of the corresponding groove 62. As shown in FIGS. 6 and 8, the upper portion 63 has the V shape in the cross sectional plane which is perpendicular to the direction of flow of the ink through the groove 62. The depth and width of the groove 62 are determined while taking account of the ease of formation of the main body 51 of the platen 42, and the ink discharge capacity of the ink-receiver portion 56.

The main body 51 has a pair of opposed flank or inner side surfaces 89, 90 defining each of the grooves 62. The bar-like member 88 accommodated within the groove 62 is not in contact with these two inner side surfaces 89, 90. The bar-like member 88 has opposite two outer side surfaces 93*a* which cooperate with the inner side surfaces 89, 90 to define therebetween first flow passages 91 corresponding to the respective two outer side surfaces 93*a* and the respective inner side surfaces 89, 90. The first flow passages 91 extend in the direction of depth of the groove 62 toward the bottom of the groove 62. The ink flows through the first flow passages 91.

The bar-like member 88 has a lower surface which cooperates with the inner side surfaces 89, 90 to define therebetween a second flow passage 92. In other words, the second flow passage 92 is a bottom part of the upper portion 63, which is partially defined by the bottom portions of the inner side surfaces 89, 90 and a flat bottom surface of the upper portion 63 at which the inner side surfaces 89, 90 almost intersects each other. The bar-like member 88 is not in contact with this flat bottom surface of the upper portion 63 of the groove 62. The second flow passage 92 extends in the direction of extension of the groove 62 along the flat bottom surface up to the upright portion 64 of the groove 62, and is held in communication with the first flow passages 91. The cross sectional size of the second flow passage 92 is determined while taking account of the required capillarity action of the second flow passage 92.

The shape and surface area of the bar-like member 88 as viewed in the transverse cross sectional plane perpendicular to the direction of flow of the ink change as the bar-like member 88 extends in the direction of the ink flow, that is, in the direction of extension of the groove 62 or sheet feeding direction. As is apparent from FIGS. 6 and 8, the thickness of the bar-like member 88 gradually or continuously increases in the sheet feeding direction. At a comparatively upstream position of the bar-like member 88 as viewed in the sheet feeding direction, the bar-like member 88 has a comparatively small thickness dimension and an accordingly small transverse cross sectional surface area, and therefore the second flow passage 92 has a comparatively large cross sectional surface area, as shown in FIG. 6. Since the capillarity action of the second flow passage 92 is inversely proportional to the cross sectional area, the capillarity action is comparatively small at the comparatively upstream position of the bar-like member 88. Thus, the capillarity action of the second flow passage 92 can be adjusted by changing the thickness of the bar-like member 88, that is, by changing the transverse cross sectional surface area of the bar-like member 88 as seen in the planes of FIGS. 6 and 8, irrespective of the depth and width dimensions of the groove 62.

At a comparatively downstream position of the bar-like member 88 as viewed in the sheet feeding direction, the bar-like member 88 has a comparatively large thickness dimension and an accordingly large transverse cross sectional surface area, and therefore the second flow passage 92 has a comparatively small cross sectional surface area, as shown in FIG. 8. Since the thickness of the bar-like member 88 continuously increases in the sheet feeding direction, the transverse cross sectional surface area of the second flow passage 92 gradually or continuously decreases as the bar-like member 88 extends in the sheet feeding direction, that is, in the direction of flow of the ink through the upper portion 63 of the groove 62.

The bar-like member 88 has an upper surface 93*b* which is exposed upwards with respect to the groove 62, that is, exposed s seen in the plan view of FIG. 3. The height of the upper surface 93*b* is determined so as to prevent or reduce generation of an ink mist, which is caused by droplets of ink which are ejected from the printing head 39 and float in the air, but are not deposited on the recording medium or the platen 42. Namely, the ink mist is caused by floating of the ejected ink droplets. The degree of generation of the ink mist depends upon the quality of each ink droplet and the distance between the printing head 39 and the platen 42. That is, the ink mist tends to be easily generated when the quantity of the ink droplet is comparatively small and the distance between the printing head 39 and the platen 42 is comparatively long. Accordingly, the height of the upper surface 93*b* of the bar-like member 88 is determined in view of a distance between the printing head 39 and the upper surface 93*b* which does not cause generation of the ink mist even when the quantity of the ink droplets is the smallest. It is noted that the height of the upper surface 93*b* of the bar-like member 88 can be adjusted or determined irrespective of the depth and width dimensions of the groove 62.

As shown in FIGS. 6 and 8, the upper surface 93*b* has an inverted-V shape defining by a pair of slant surfaces inclined from its center toward the respective inner side surfaces 89, 90 of the groove 62, that is, toward the first flow passages 91. The inverted-V shape of the upper surface 93*b* remains constant over the entire length of the bar-like member 88.

There will next be described in detail the function of the platen 42. According to a command input through the operator's control panel 4, one of the margin printing mode and non-margin printing mode of the printer portion 2 is selected. In the margin printing mode, an image is printed on the recording medium with a margin left along each of its four edges. In the non-margin printing mode, an image is printed without margins left along its leading and trailing edges, for example, or along its leading and trailing edges and along its right and left edges. The margin printing mode which does not directly relate to the principle of this invention will not be further described.

In the non-margin printing mode, the ink droplets are ejected from the selected nozzles of the printing head 39 which correspond to the ink-receiver portion 56. The recording medium such as a sheet of paper (hereinafter referred to as "paper sheet") fed onto the platen 42 is initially supported by the ribs 59, and is then supported by the projection 87 as well as the ribs 59. The paper sheet supported by the ribs 59 and projection 87 is spaced apart upwards from the grooves 62 and bar-like members 88 of the ink-receiver portion 56.

Accordingly, the back surface of the paper sheet is protected against contamination with the ink.

The ejection of the ink droplets from the printing head 39 is controlled according to image data representative of an image which is larger than the recording surface of the paper sheet. Namely, the ink droplets are ejected onto not only the recording surface of the paper sheet, but also areas outside the paper sheet. Accordingly, the desired image is printed on the paper sheet over its entire length, without margins left along the leading and trailing edges of the paper sheet, for example.

The ink droplets ejected in the areas outside the leading and trailing edges of the paper sheet are deposited on the ink-receiver portion 56. Described in greater detail, the bar-like members 88 are accommodated within the upper portions 63 of the corresponding grooves 62 formed in the ink-receiver portion 56, so that the printing head 38 is opposed to the upper parts of the inner side surfaces 89, 90 of the grooves 62 and the upper surfaces 93*b* of the bar-like members 88.

In the ink-receiver portion 56, the grooves 62 and the bar-like members 88 are arranged in the direction perpendicular to the direction of extension of the grooves 62, that is, in the direction of reciprocation of the printing head 39. Accordingly, the ink droplets ejected onto the areas ahead of the leading edge and behind the trailing edge of the paper sheet, as well as the ink droplets ejected onto the areas sideways of the right and left edges of the paper sheet can be received in the grooves 62 and deposited on the bar-like members 88. The provision of the multiplicity of the grooves 62 and the corresponding bar-like members 88 facilitates the flows of the ink at different positions corresponding to the multiple grooves 62, whereby the discharging of the ink from the ink-receiver portion 56 into the ink-container portion 57 is promoted.

As described above, the height of the upper surface 93*b* of each bar-like member 88 corresponds to the distance between the printing head 39 and the platen 42, which does not cause generation of an ink mist due to the ejection of the ink droplets. Accordingly, the ink droplets ejected from the printing head 39 can be deposited onto the upper surface 93*b* of the bar-like member 88, without floating of the ink droplets in the air. Since the upper surface 93*b* consists of the pair of descending slant surfaces leading to the first flow passages 91, as described above, the ink droplets deposited on the upper surface 93*b* of the bar-like member 88 easily flow by gravity into the first flow passages 91.

The ink which has flown into the first flow passages 91 further flows downwards by gravity into the second flow passage 92, The ink in the second flow passage 92 flows owing to the capillarity action in the direction of extension of the second flow passage 92, that is, in the direction of extension of the groove 62. As described above, each groove 62 is closed at its upstream end of the upper portion 63 by the upper portion 61 of the main body 51, and is continuous at its down stream end with the upright portion 64. Accordingly, the ink flowing through the second flow passage 92 further flows down into the upright portion 64.

As described above, the thickness of the bar-like member 88 partially defining the second flow passage 92 gradually or continuously increases as it extends in the sheet feeding direction, so that the surface area of the bar-like member 88 as viewed in the transverse cross sectional plane perpendicular to the direction of flow of the ink gradually or continuously decreases in the sheet feeding direction, that is, in the direction toward the upright portion 64. Accordingly, the capillarity action of each second flow passage 92 gradually or continuously increases in the direction of flow of the ink, so that the flow of the ink through the second flow passage 92 is promoted, whereby the capacity of the upper portion 63 of the groove 62 to discharge the ink is increased. Further, the inverted-V shape of the groove 62 as viewed in the transverse cross sectional plane perpendicular to the direction of flow of the ink permits a gradual increase of the capillarity action of the groove 62 in the downward direction toward its bottom. Thus, the capillarity action of the second flow passage 92 can be easily increased.

The ink which has flown through the second flow passage 92 into the upright portion 64 flows by gravity into the lower portion 65 of the groove 62. The ink in the lower portion 65 flows in the sheet feeding direction due to a continuous flow of the ink from the upright portion 64 into the lower portion 65. As described above, the lower portion 65 is in communication at its downstream end with the upstream end of the ink-container portion 57 in which the ink absorber 53 is accommodated, so that the ink flowing through the lower portion 66 flows into the ink absorber 53 and is retained therein. Accordingly, flows of the ink through the first and second flow passages 91, 92 in the direction opposite to the sheet feeding direction are effectively prevented, so that the ink can smoothly flow through the upper, upright and lower portions 63, 64, 65 of the groove 62.

In the ink-jet printing platen 42 constructed according to the present embodiment of this invention described above, the ink droplets are deposited on the bar-like members 88 accommodated in the grooves 62 formed in the main body 51, so that the distance between the printing head 39 and the bar-like member 88 can be adjusted irrespective of the depth of the grooves 62, so as to prevent or reduce the generation of the ink mist from the ejected ink droplets.

In addition, the transverse cross sectional surface areas of the first and second flow passages 91, 92 can be adjusted by adjusting the dimensions of the gaps formed between the inner side surfaces 89, 90 of the grooves 62 and the surfaces of the bar-like members 88. Accordingly, the capillarity action of each groove 62 can be increased by reducing the transverse cross sectional surface areas of the first and second flow passages 91, 92, irrespective of the depth and width dimensions of the groove 62.

Second Embodiment

There will next be described a platen 100 constructed according to a second embodiment of this invention, which is different in construction from the platen 42 of the first embodiment. The platen 100 is used for the multi-function device 1 which includes the printer portion 2 and which is constructed as descried above with respect to the first embodiment.

Figure 9:
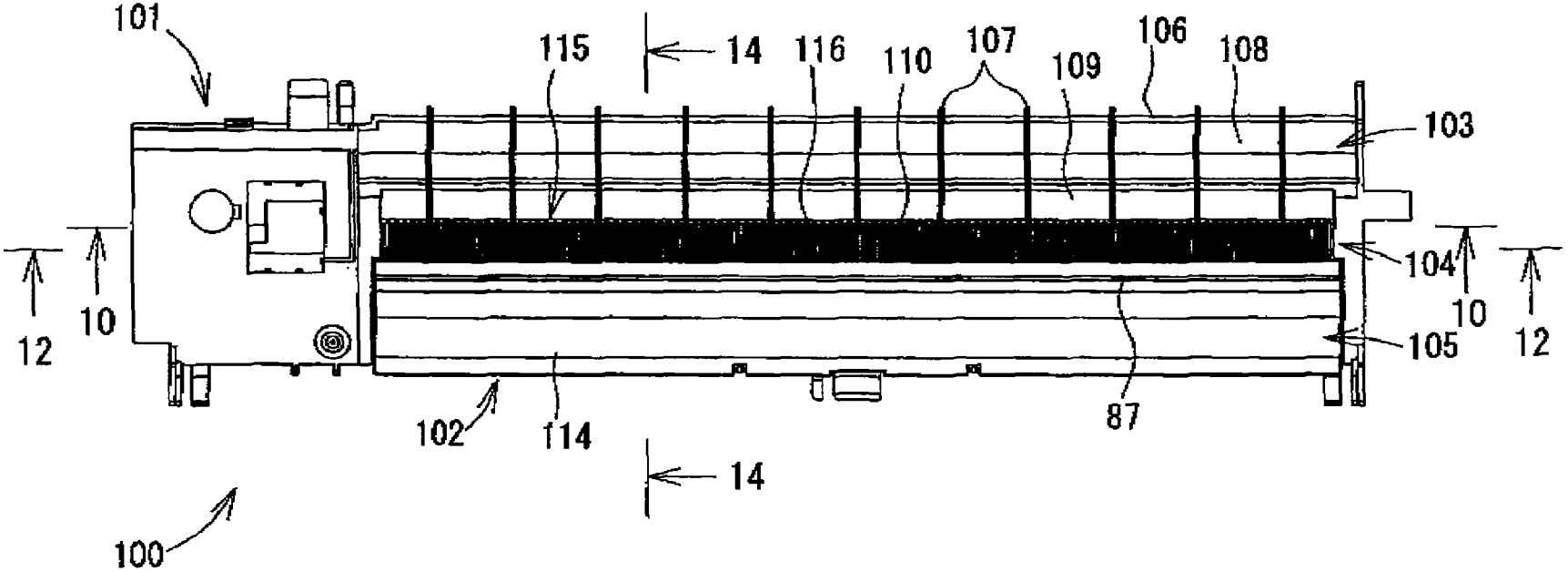
FIG. 9 is a plan view of a platen 100 constructed according to a second embodiment of this invention.
Figure 10:
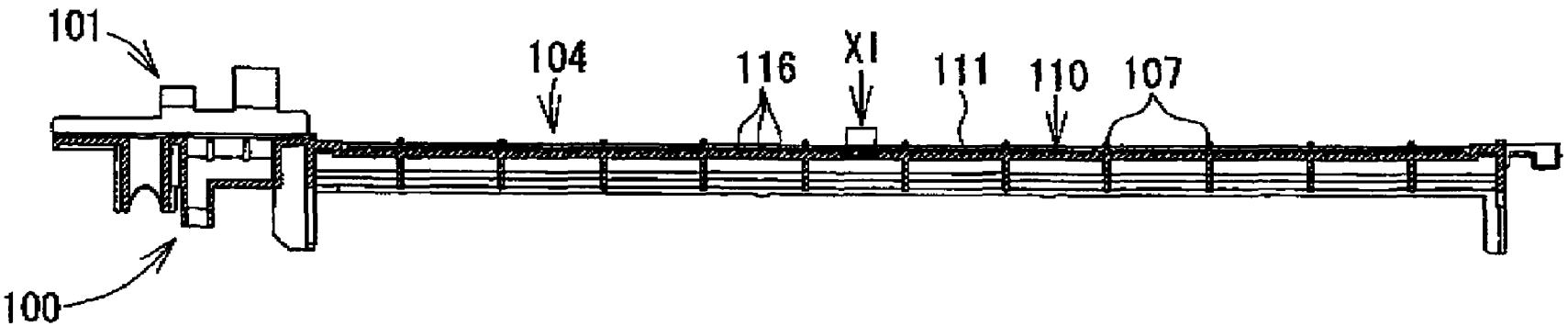
FIG. 10 is a cross sectional view taken alone line 10-10 of FIG. 9.
Figure 11:
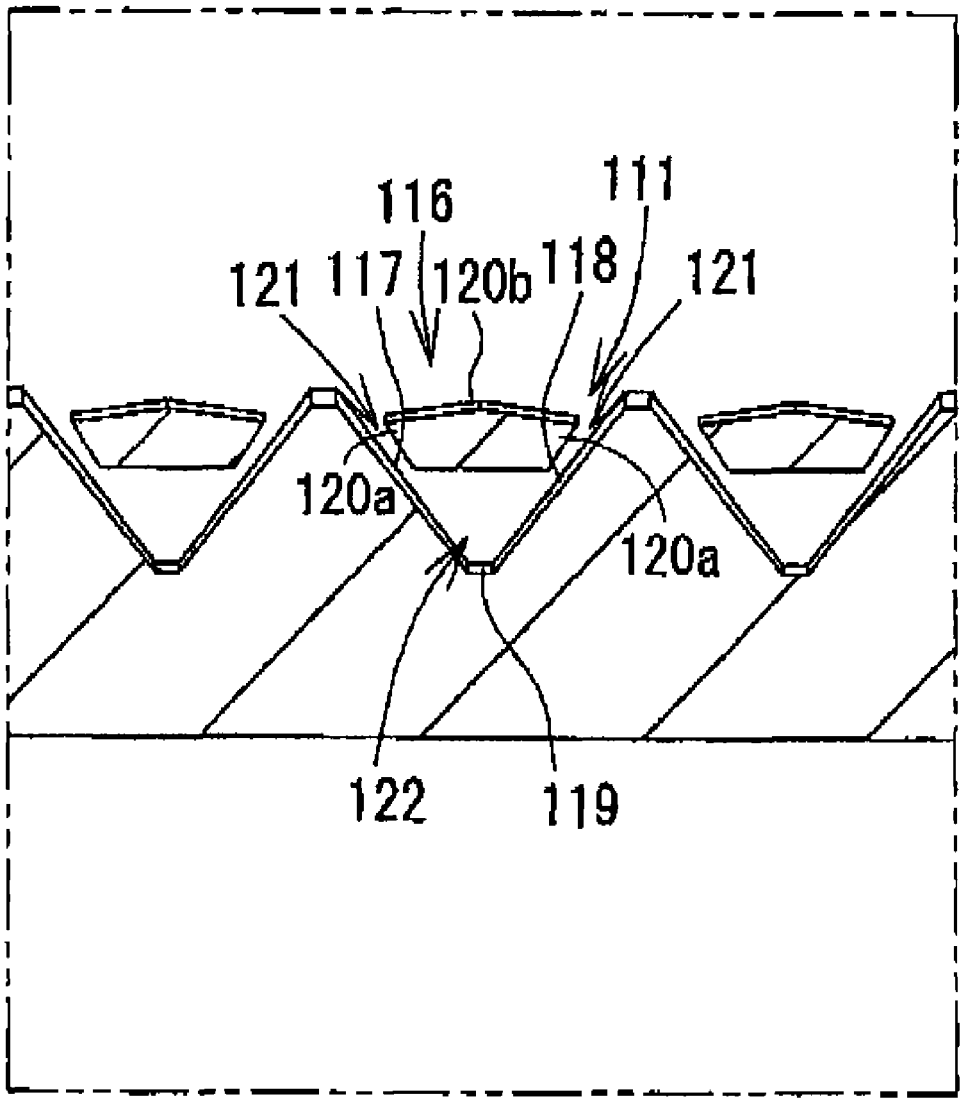
FIG. 11 is an enlarged view of a part XI of the platen 100 of FIG. 10.
Figure 12:
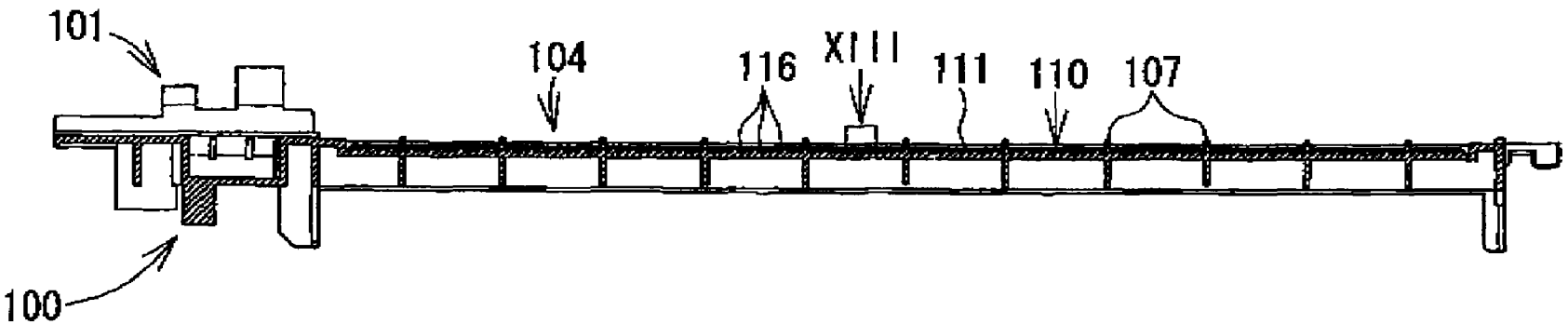
FIG. 12 is a cross sectional view taken along line 12-12 of FIG. 9.
Figure 13:
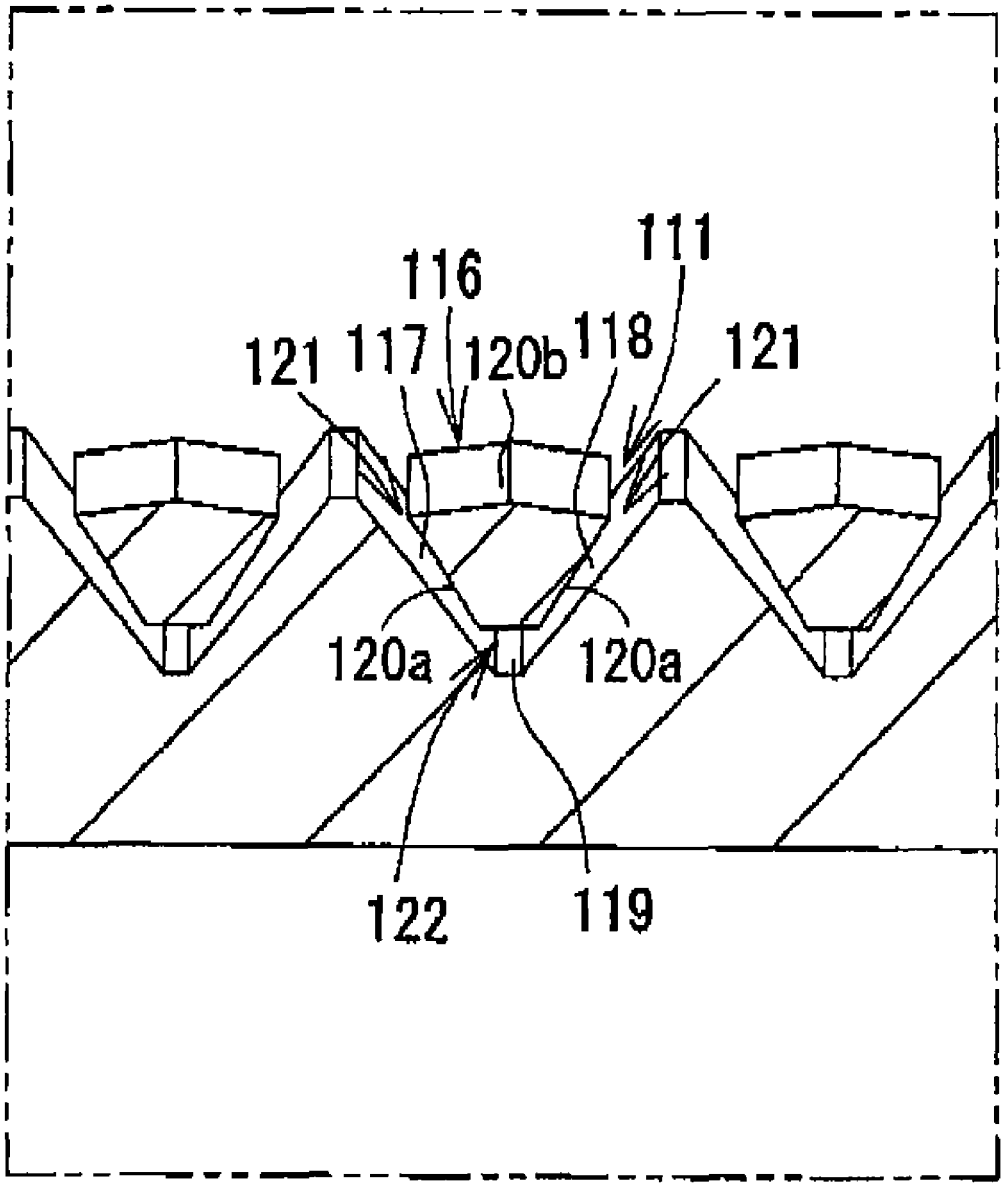
FIG. 13 is an enlarged view of a part XIII of the platen 100 indicated in FIG. 12.
Figure 14:
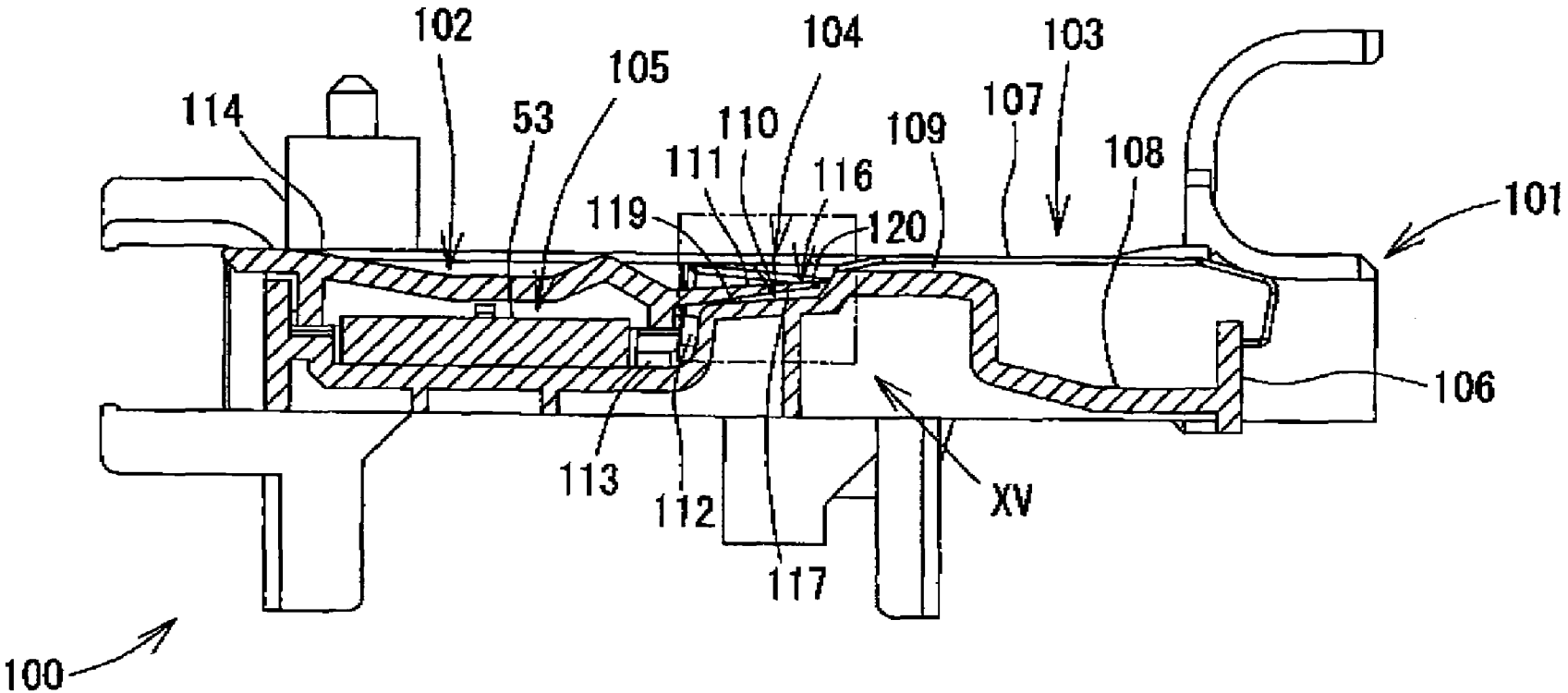
FIG. 14 is a cross sectional view taken along line 14-14 of FIG. 9.
Figure 15:
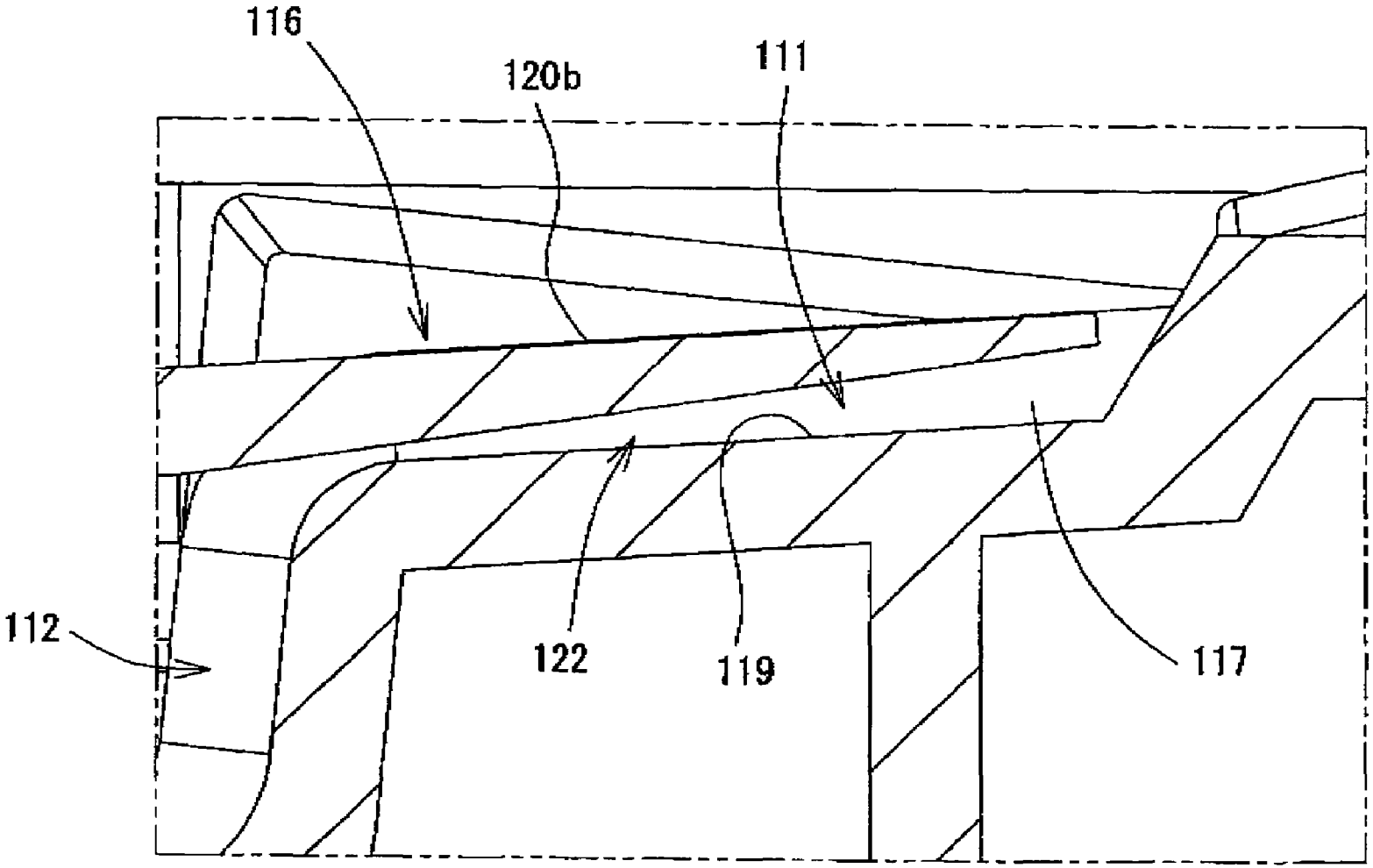
FIG. 15 is an enlarged view of a part XV of the platen 100 indicated in FIG. 14.

FIG. 9 is a plan view of the platen 100 of the second embodiment, and FIG. 10 is a cross sectional view taken alone line 10-10 of FIG. 9, while FIG. 11 is an enlarged view of a part XI of the platen 100 of FIG. 9. FIG. 12 is a cross sectional view taken along line 12-12 of FIG. 9, and FIG. 13 is an enlarged view of a part XIII of the platen 100 indicated in FIG. 12; FIG. 14 is a cross sectional view taken along line 14-14 of FIG. 9, and FIG. 15 is an enlarged view of a part XV of the platen 100 indicated in FIG. 14;

As shown in FIG. 9, the platen 100 includes a main body 101 and a covering member 102. The ink absorber 53 described above with respect to the first embodiment is accommodated in a space formed between the main body 101 and the covering member 102, as shown in FIG. 14. Like the platen 42 of the first embodiment, the platen 100 is a generally planar member as a whole.

The main body 101 of the platen 100 consists of three major portions, that is, a medium-supporter portion 103 disposed on the upstream side as viewed in the feeding direction of the paper sheets, an ink-receiver portion 104 disposed in an intermediate part as viewed in the sheet feeding direction, and an ink-container portion 105 disposed on the downstream side, The ink-receiver portion 104 is different in construction from the ink-receiver portion 56 in the first embodiment.

The medium-supporter portion 103 has a base plate 106, and a medium-support portion in the form of a plurality of ribs 107. The base plate 106 includes a lower section 108 and an upper section 109 which are similar to the lower and upper sections 60, 61 in the first embodiment. The ribs 59 project upright from the base plate 106.

The ink-receiver portion 104 has a multiplicity of grooves 110 each of which is V-shaped and open upwards as viewed in the transverse cross sectional plane. The grooves 110 extend in the transverse direction of the main body 101, and have a length equal to a dimension of a rectangular area in which the nozzles from which the ink droplets are ejected only in the non-margin printing mode. Each groove 110 has an upstream end at the downstream end of the upper section 109, as viewed in the sheet feeding direction. The upper surface of the upper section 109 has a larger height than the surface of the ink-receiver portion 104 in which the grooves 110 are formed. Accordingly, the grooves 110 are closed at the upstream ends by the upper section 109. The top surface of each rib 107 has a larger height than the above-indicated surface of the ink-receiver portion 104.

As shown in FIG. 14, the grooves 110 have downstream ends at the upstream end of the ink-container portion 105. The ink-container portion 105 has a smaller height than the ink-receiver portion 104, In the presence of a difference in height between the ink-receiver portion 104 and the ink-container portion 105, each groove 110 consists of an upper portion 111, an upright portion 112 and a lower portion 113, which are formed continuously to permit a flow of ink. The configuration of the upper portion 111 will be described in detail. The downstream end of the groove 110 as viewed in the sheet feeding direction, that is, the downstream end of the lower portion 113 is open to the ink-container portion 105, so that the ink flowing through the lower portion 113 can flow onto the ink-container portion 105. The grooves 110 are formed at a predetermined pitch in the longitudinal direction of the main body 101, such that the adjacent two grooves 110 are spaced apart from each other in the above-indicated longitudinal direction by a vertically projecting tooth having an inverted V shape.

The ink-container portion 105 is a container structure which is open upwards and which has a bottom wall 119 having a smaller height than the upper portion 111 of the grooves 110. Like the ink-container portion 57 in the first embodiment, the ink-container portion 105 has a rectangular shape as seen in the plan view of FIG. 9. The ink absorber 53 is accommodated in the container structure of the ink-container portion 105.

The covering member 102 includes a covering portion 114 covering the ink-container portion 105, and a comb portion 115 having a multiplicity of elongate members in the form of bar-like members 116 arranged in a comb-like pattern. The covering member 102 is a one-piece structure formed of a synthetic resin. The covering portion 102 has the same configuration as the covering portion 76 in the first embodiment.

The comb portion 115 includes the multiplicity of bar-like members 116 arranged in the longitudinal direction of the covering portion 102 such that the bar-like members 116 are equally spaced apart from each other by a predetermined spacing distance. That is, the bar-like members 116 corresponding to the respective grooves 110 are arranged in the direction perpendicular to the direction of extension of the grooves 110 such that the bar-like members 116 are parallel to each other. Each of the bar-like members 116 extends from the upstream end of the covering portion 114 in the direction opposite to the sheet feeding direction. The bar-like member 116 has cross sectional dimensions that can be accommodated in the upper portion 111 of the corresponding groove 110, and a length almost equal to the length of the upper portion 111. The comb portion 116 is positioned relative to the covering member 102 such that the bar-like members 116 are accommodated in the upper portions 111 of the respective grooves 110 when the covering member 102 is fixed in position to the main body 101.

There will be described in detail the configuration of the upper portion 111 of each groove 110 and the configuration of each bar-like member 166, by reference to FIGS. 5-8. As shown in these figures, each bar-like member 116 is accommodated within a space of the upper portion 111 of the corresponding groove 110. As shown in FIGS. 11 and 13, the upper portion 111 has the V shape in the cross sectional plane which is perpendicular to the direction of flow of the ink through the groove 110. The depth and width of the groove 110 are determined while taking account of the ease of formation of the main body 101 of the platen 100, and the ink discharge capacity of the ink-receiver portion 104. The groove 110 is defined by a pair of opposed flank or inner side surfaces 117, 118 and the above-indicated bottom surface 119, as shown in FIG. 11. As shown in FIG. 15, the depth of the upper portion 111 gradually increases as the upper portion 111 extends toward the upright portion 112. That is, the bottom surface 119 of the groove 110 is inclined downwards toward the upright portion 112. Further, an upper surface 120*b* of the bar-like member 116 consists of a pair of slant surfaces which are inclined downwards toward the upright portion 112 in the longitudinal direction of the upper portion 111

The bar-like member 116 accommodated within the groove 110 is not in contact with these two inner side surfaces 117, 118. The bar-like member 116 has opposite two outer side surfaces 120*a* which cooperate with the inner side surfaces 117, 118 to defile therebetween first flow passages 121, which consists of two portions corresponding to the respective two side surfaces 12*oa* and the respective inner side surfaces 117, 118. The first flow passages 121 extend in the direction of depth of the groove 110 toward the bottom surface 119. The ink flows through the first flow passage 121.

The bar-like member 116 is not in contact with the bottom surface 119, either. The bar-like member 116 has a lower surface which cooperates with the inner side surfaces 117, 118 and the bottom surface 119 to define a second flow passage 122. The second flow passage 122 extends in the direction of extension of the groove 110 along the inclined bottom surface 119 up to the upright portion 112 of the groove 110, and is held in communication with the first flow passages 121. The cross sectional size of the second flow passage 122 is determined while taking account of the required capillarity action of the second flow passage 122.

The shape and surface area of the bar-like member 116 as viewed in the transverse cross sectional plane perpendicular to the direction of flow of the ink change as the bar-like member 116 extends in the direction of the ink flow, that is, in the direction of extension of the groove 110 or sheet feeding direction. As is apparent from FIGS. 11, 13 and 15, the thickness of the bar-like member 110 gradually or continuously increases in the sheet feeding direction. At a comparatively upstream position of the bar-like member 116 as viewed in the sheet feeding direction, the bar-like member 116 has a comparatively small thickness dimension and an accordingly small transverse cross sectional surface area, and therefore the second flow passage 122 has a comparatively large cross sectional surface area, as shown in FIG. 11.

At a comparatively downstream position of the bar-like member 116 as viewed in the sheet feeding direction, the bar-like member 116 has a comparatively large thickness dimension and an accordingly large transverse cross sectional surface area, and therefore the second flow passage 122 has a comparatively small cross sectional surface area, as shown in FIG. 13. Since the thickness of the bar-like member 116 continuously increases in the sheet feeding direction, the transverse cross sectional surface area of the second flow passage 122 gradually or continuously decreases as the bar-like member 116 extends in the sheet feeding direction, that is, in the direction of flow of the ink through the upper portion 111 of the groove 110.

The bar-like member 116 has an upper surface 120*b*, which has an inverted-V shape, like the upper surface 93*b* of the bar-like member 88 in the first embodiment. That is, the inverted-V shape is defining by a pair of slant surfaces descending from its center toward the respective inner side surfaces 117, 118 of the groove 110, that is, toward the two portions of the first flow passages 121. The height of the upper surface 120*b* in the groove 110 is determined to prevent or reduce the generation of the ink mist.

There will next be described in detail the function of the platen 100 of the second embodiment. In this embodiment, too, one of the margin printing mode and non-margin printing mode of the printer portion 2 is selected according to a command input through the operator's control panel 4, and an image is printed on the recording medium in the manner depending upon the selected printing mode.

In the non-margin printing mode, the ink droplets ejected from the selected nozzles of the printing head 39 which are located outside the edges of the paper sheet are deposited on the ink-receiver portion 104. Since the height of the upper surface 120*b* of each bar-like member 116 corresponds to the distance between the printing head 39 and the platen 100, which does not cause the generation of the ink mist, the ink droplets ejected from the printing head 39 can be deposited onto the upper surface 120*b* of the bar-like member 116, without floating of the ink droplets in the air. The ink droplets deposited on the upper surface 120*b* of the bar-like member 116 easily flow by gravity into the first flow passages 121.

The ink which has flown into the first flow passages 121 further flows downwards by gravity into the second flow passage 122. The ink in the second flow passage 122 flows, owing to the capillarity action and the gravity; in the direction of extension of the second flow passage 122, that is, in the direction of extension of the groove 110.

As described above, the thickness of the bar-like member 116 partially defining the second flow passage 122 gradually or continuously decreases as it extends in the sheet feeding direction, so that the surface area of the bar-like member 116 as viewed in the transverse cross sectional plane perpendicular to the direction of flow of the ink gradually or continuously decreases in the sheet feeding direction, that is, in the direction toward the upright portion 112. Accordingly, the capillarity action of each second flow passage 122 gradually or continuously increases in the direction of flow of the ink, so that the flow of the ink through the second flow passage 122 is promoted, whereby the capacity of the upper portion 111 of the groove 110 to discharge the ink is increased.

As described above, the depth of the upper portion 111 of the groove 110 gradually increases as the upper portion 111 extends in the direction of flow of the ink through the upper portion 111. Namely, the bottom surface 119 is inclined downwards toward the upright portion 112. Accordingly, the ink flow through the second flow passage 122 is promoted by the gravity action. The ink which has flown through the second flow passage 122 into the upright portion 112 flows by gravity into the lower portion 113, as in the platen 42 of the first embodiment.

In the present second embodiment described above, the transverse cross sectional surface areas of the first and second flow passages 121, 122 can be adjusted by adjusting the dimensions of the gaps formed between the inner side surfaces 117, 118 of the grooves 110 and the surfaces of the bar-like members 116. In addition, a gradual increase of the depth of the bottom surface 119 in the direction of flow of the ink through the second flow passage 122 permits a further decrease of the transverse cross sectional surface area of the second flow passage 122. The thus decreased transverse cross sectional surface area of the second flow passage 122 cooperates with the gravity action to further promote the flow of the ink through the second flow passage 122.

In the platen 100 of the second embodiment, too, the distance between the printing head 39 and the bar-like members 116 can be adjusted irrespective of the depth of the grooves 110, to prevent or reduce the generation of the ink mist due to the ink droplets deposited on the bar-like members 116 accommodated in the respective grooves 110 formed in the main body 101 of the platen 100.

In the first and second embodiments, the elongate members in the form of the bar-like members 88, 116 extend from the covering portion 76, 114 in the direction opposite to the feeding direction of the recording medium, and the covering member 52, 102 is fixed to the main body 51, 101 so that the bar-like members 88, 116 are positioned in place in the grooves 62, 110 so as to define the first flow passages 91, 121 and the second flow passage 122. However, this arrangement to position the bar-like members 88, 116 in place in the grooves 62, 110 is not essential. For instance, the bar-like members 88, 116 may be fixed to the upper section 61, 109 of the main body 51, 101, so as to define the first and second flow passages 91, 92, 121, 122.

Third Embodiment

Figure 16:
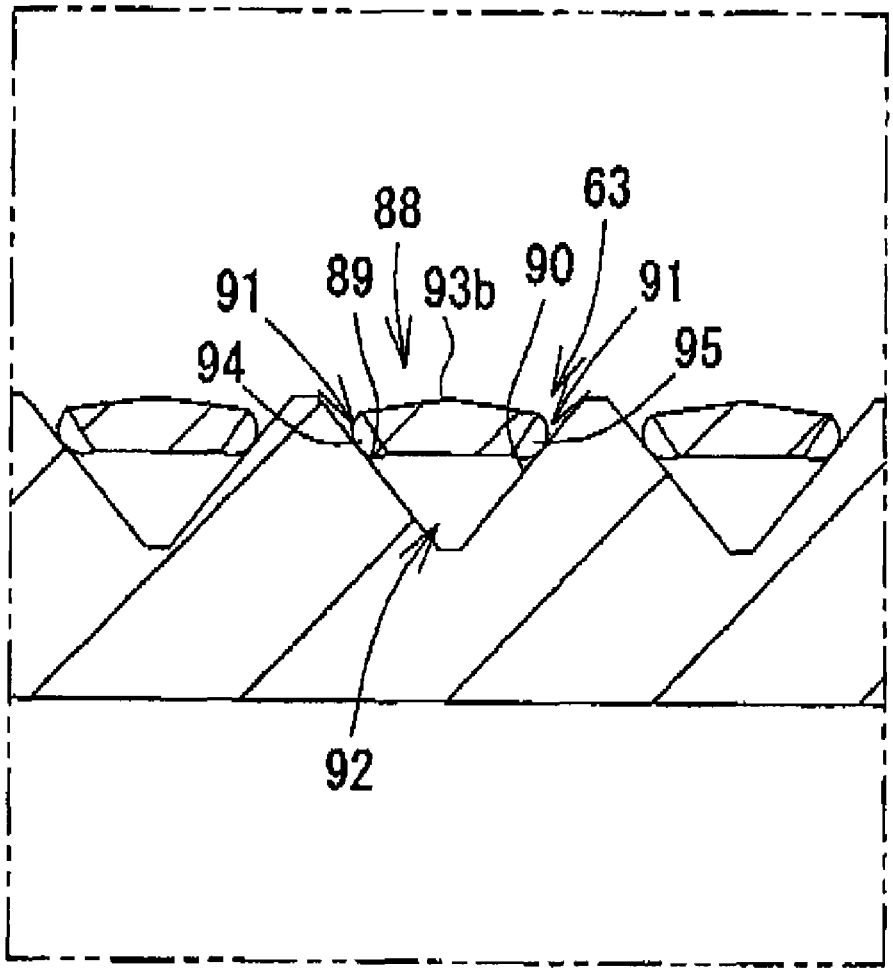
FIG. 16 is an enlarged cross sectional view of first flow passages 91 and a second flow passage 92 of a platen constructed according to a third embodiment of this invention, which is a first modification of the first embodiment.

Reference is now made to the enlarged cross sectional view of FIG. 16 showing the first flow passages 91 and the second flow passage 92 partially defined by the bar-Like member 88 according to a third embodiment of this invention, which is a first modification of the first embodiment. In this modification, each bar-like member 88 has hemispherical protrusions 94, 95 which extend from its respective two opposite side surfaces and which are opposed to the respective two flank or inner side surfaces 89, 90. The hemispherical protrusions 94 are arranged at a predetermined pitch in the longitudinal direction of the bar-like member 88, that is, in the direction of extension of the groove 62. Similarly, the hemispherical protrusions 95 are arranged at the predetermined pitch in the longitudinal direction of the bar-like member 88. When the bar-like member 88 is accommodated within the groove 62, the hemispherical protrusions 94, 95 are held in contact with the respective side surfaces 89, 90, whereby the bar-like member 88 is positioned in place relative to the groove 62 such that the plurality of pairs first flow passages 91 and the single second flow passage 92 are defined by the bar-like member 88 and the inner side surfaces 89, 90.

Fourth Embodiment

Figure 17:
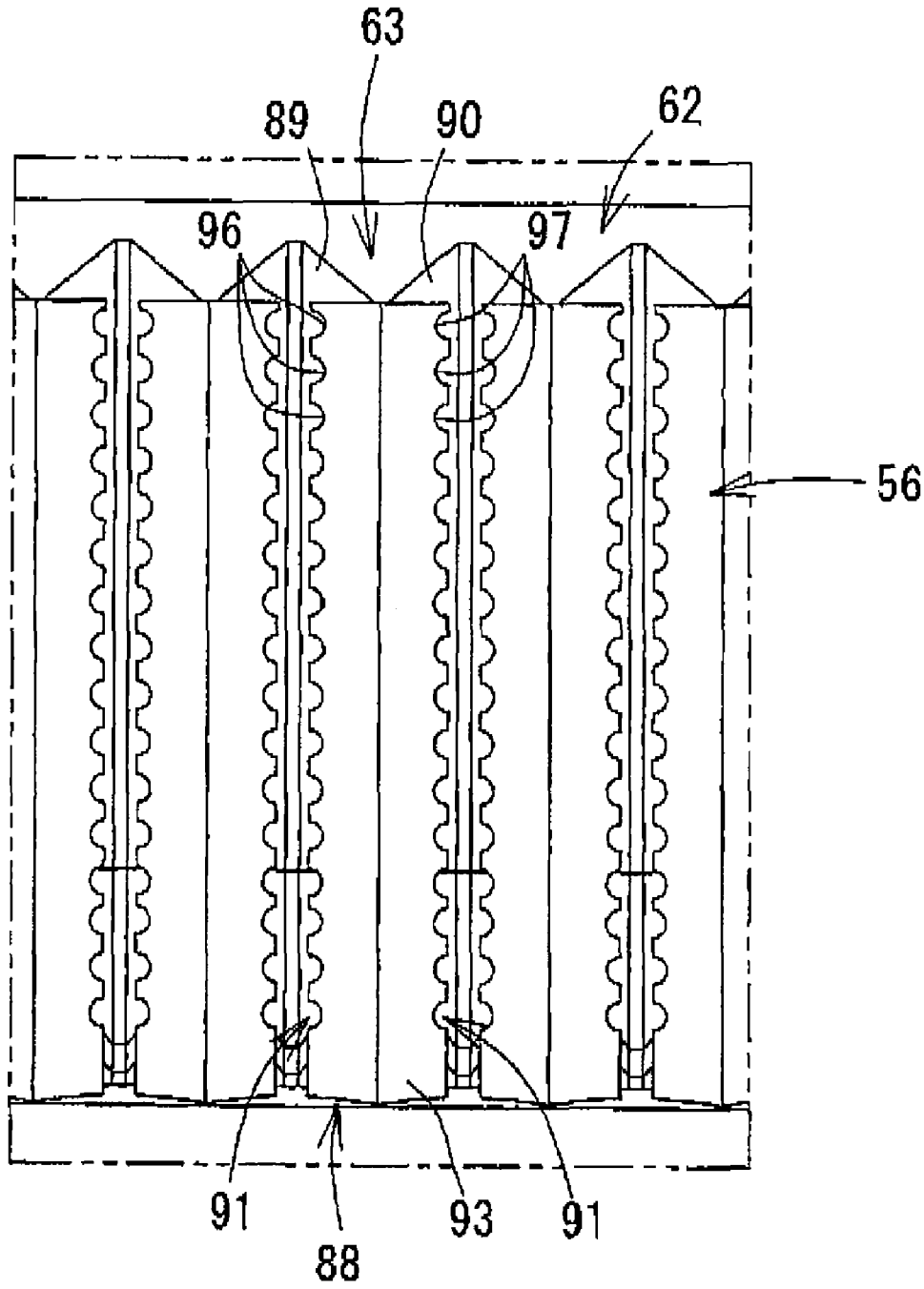
FIG. 17 is an enlarged plan view of an ink-receiver portion 56 of a platen constructed according to a fourth embodiment of the invention, which is a second modification of the first embodiment.

Referring next to the enlarged plan view of FIG. 17 showing the ink-receiver portion 56 of the platen 42 according to a fourth embodiment of this invention, which is a second modification of the first embodiment. In this second modification, each bar-like member 88 has recesses 96, 97 formed in its respective opposite side surfaces. Each recess 96, 97 is formed over the entire thickness of the bar-like member 88. The recesses 96 are arranged at a predetermined pitch in the longitudinal direction of the bar-like member 88, that is, in the direction of extension of the upper portion 63 of the groove 62. Similarly, the recesses 97 are arranged at the predetermined pitch in the longitudinal direction of the bark-lie member 88. When the bar-like member 88 is accommodated within the corresponding groove 62, the opposite side surfaces of the bar-like member 88 are held in contact with the respective side surfaces 89, 90 of the groove 62, whereby the bar-like member 88 is positioned in place relative to the groove 62 such that the plurality of pairs of first flow passages 91 and the single second flow passage 92 are defined by the bar-like member 88 and the side surfaces 89, 90. The first flow passages 91 are defined by the side surfaces 89, 90 and the recesses 96, 97. The second flow passage 97, which is not shown in FIG. 17, is formed between the bottom surface of the groove 62, and the lower surface of the bar-like member 88 which is not in contact with the side surfaces 80, 90 and the bottom surface of the groove 62.

Fifth Embodiment

Figure 18:
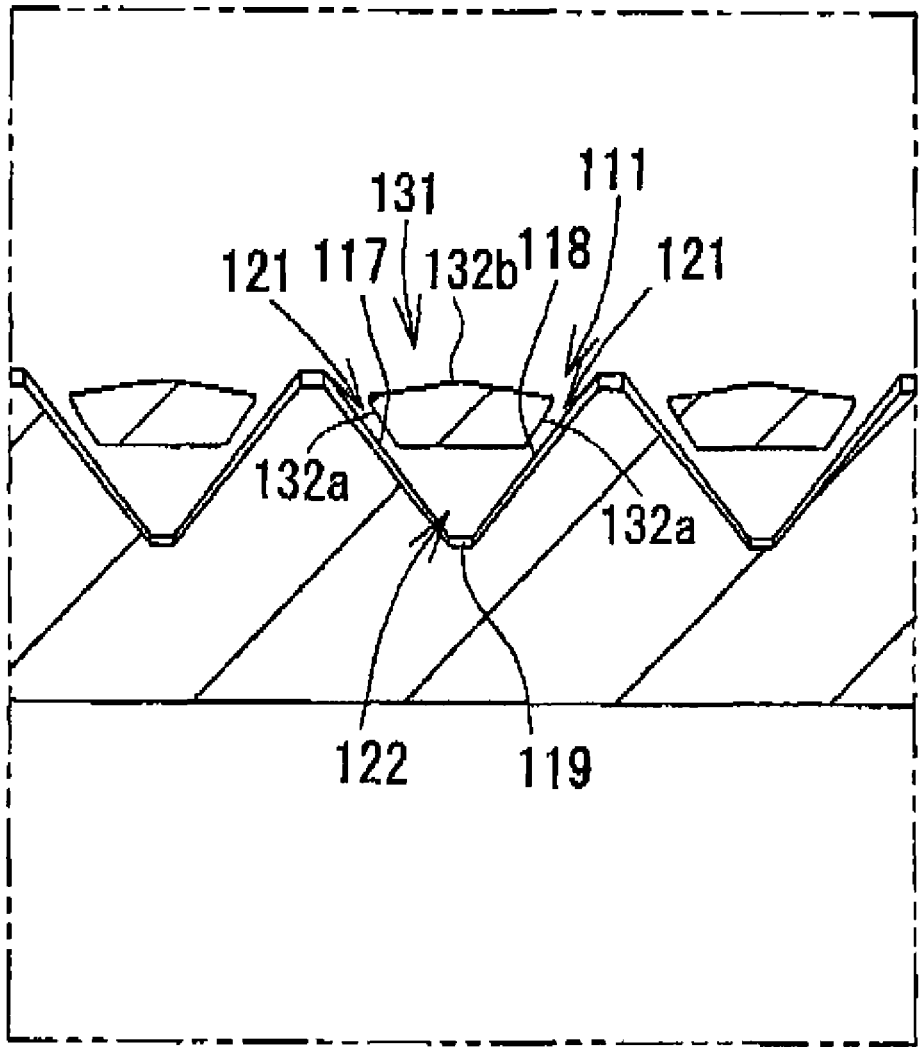
FIGS. 18-20 are enlarged views corresponding to those of FIGS. 11, 13 and 15, showing respective parts of a platen according to a fifth embodiment of this invention.
Figure 19:
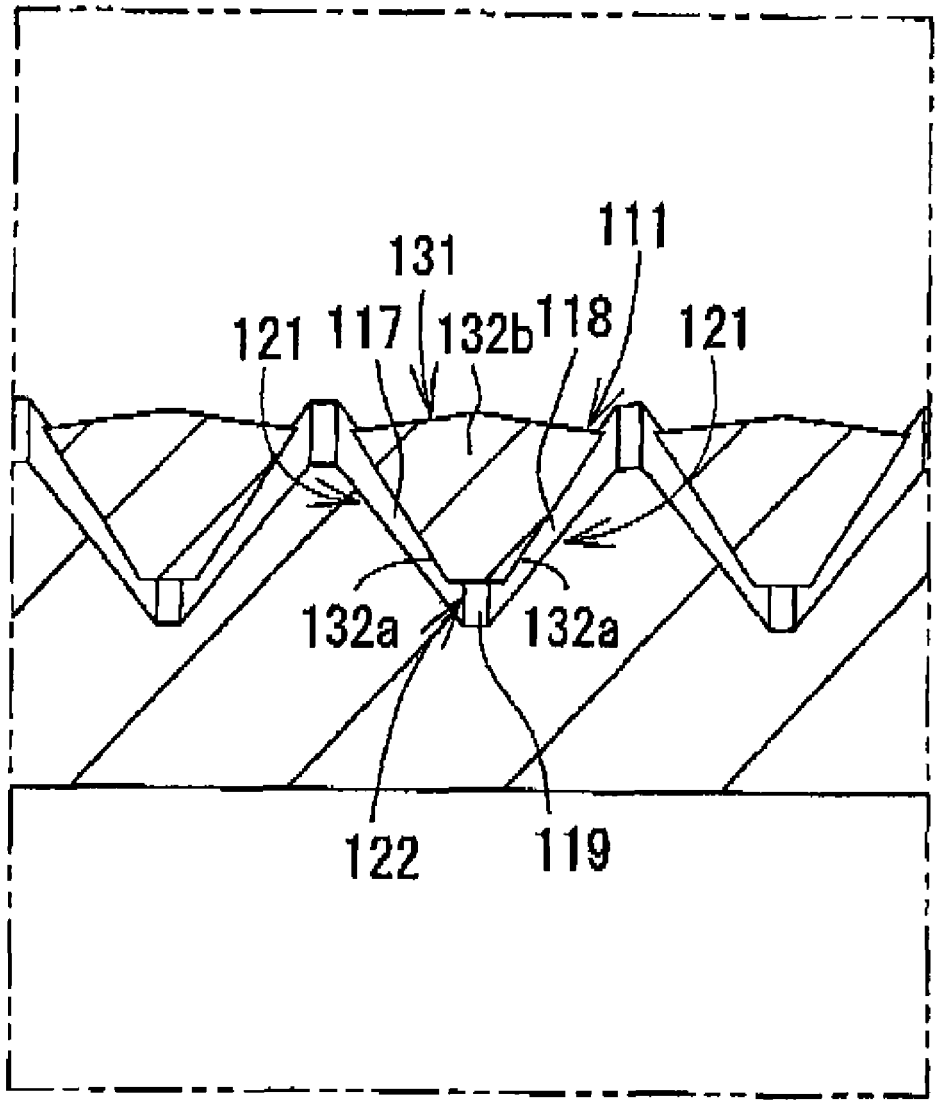
Figure 20:
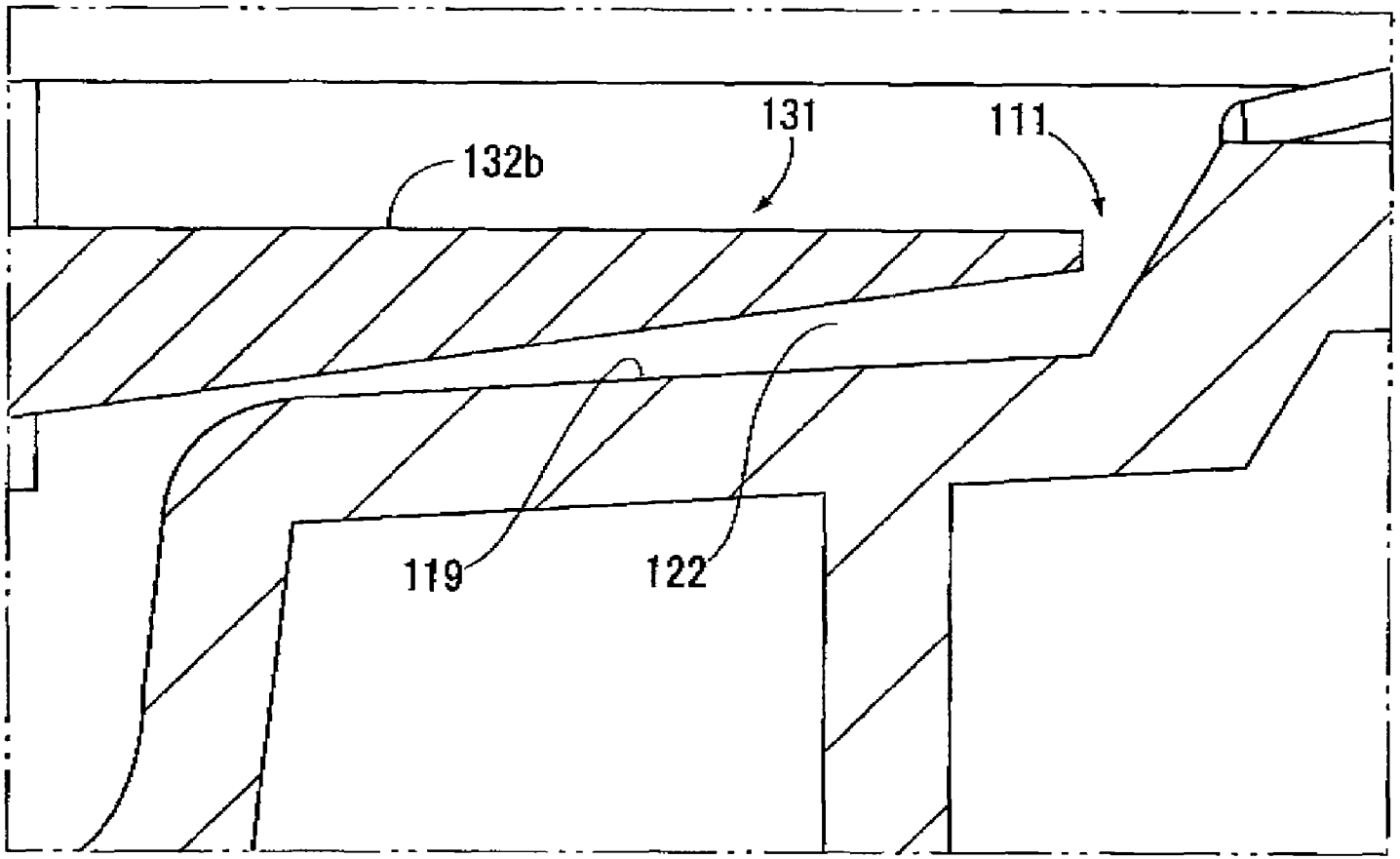

Referring to FIGS. 18-20, there will be described a platen constructed according to a fifth embodiment of this invention, FIGS. 18, 19 and 20 are enlarged views corresponding to those of FIGS. 11, 13 and 15. The platen according to the present fifth embodiment is different from the platen of the second embodiment of FIGS. 9-15 in that an upper surface 132*b* of each bar-like member 131 of the platen of the fifth embodiment is not inclined downward toward the upright portion 112, in the longitudinal direction of the upper portion 111 of the groove 110, unlike the upper surface 120*b* of the bar-like member 116 of the platen of the second embodiment. The bar-like member 131 has two outer side surfaces 132*a*. As in the second embodiment, the bottom surface 19 of the groove 110 is inclined downward toward the upright portion 112, that is, in the direction of flow of the ink, and the upper surface 132*b* of the bar-like member 131 has an inverted-V shape defining by a pair of slant surfaces descending from its center toward the respective inner side surfaces 117, 118 of the groove, that is, toward the first flow passages 121. However, the upper surface 132*b* is not inclined in the longitudinal direction of the upper portion 111, but is held level, extending in the horizontal direction, as shown in FIG. 20. Accordingly, a distance between the upper surface of the platen (the upper surface of the main body 51) and the upper surface 132*b* of the bar-like member 131 does not increase in the direction of flow of the ink, assuring effective prevention of an ink mist.

Sixth Embodiment

Figure 21:
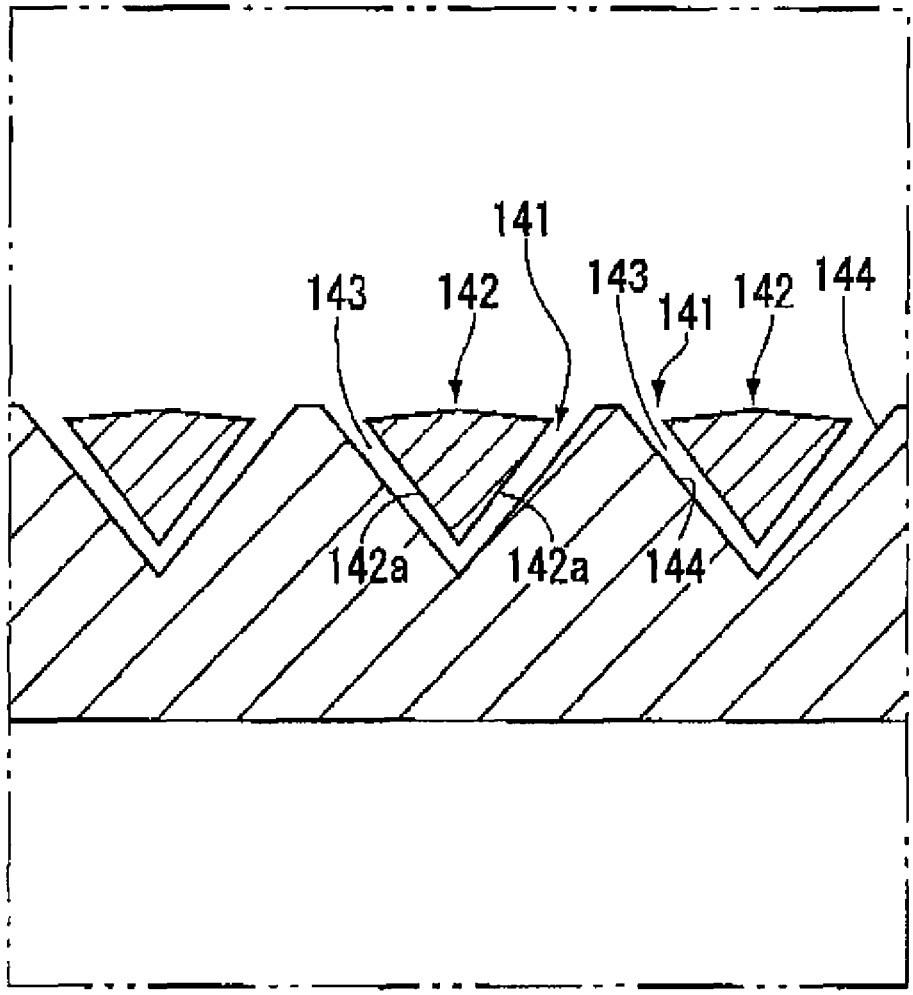
FIGS. 21 and 22 are enlarged views corresponding to those of FIGS. 11 and 13, showing respective parts of a platen according to a sixth embodiment of the present invention.
Figure 22:
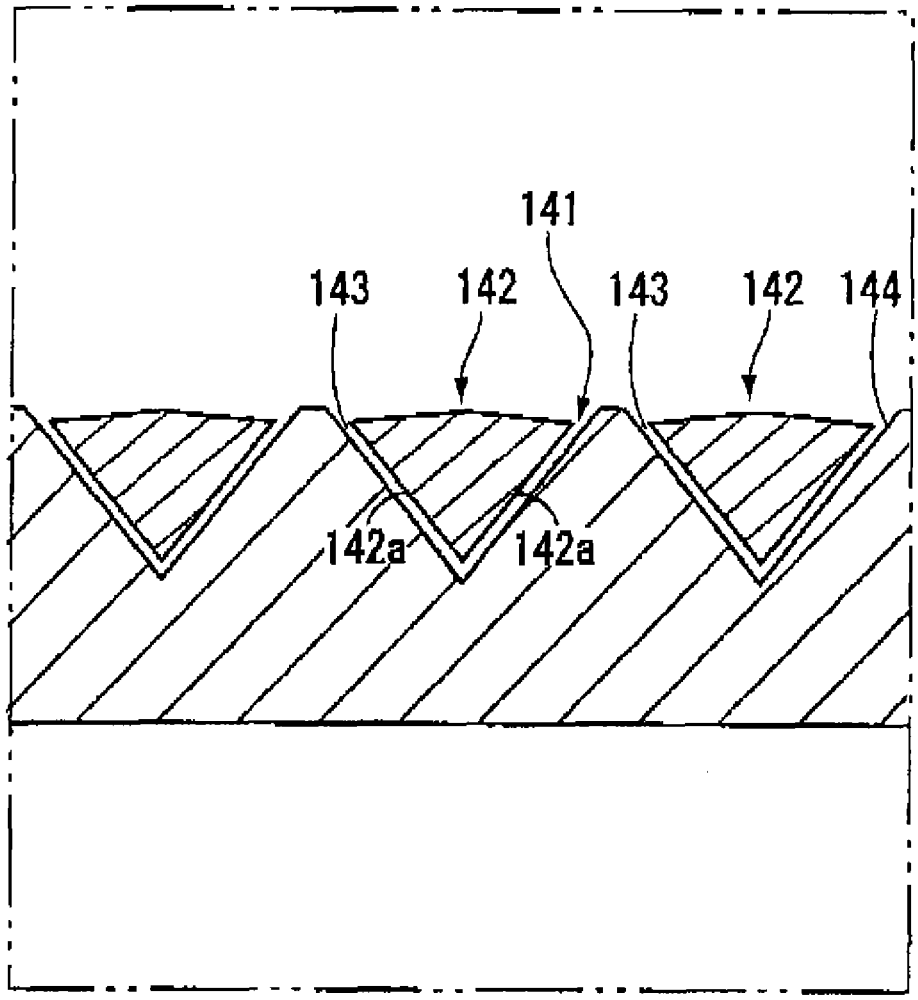

In the preceding embodiments, the ink flow passages formed by the gaps between the upper portion 63, 111 of the groove 61, 110 and the bar-like member 88, 116, 131 consist of the first flow passages 91, 121 and the second flow passage 92, 122. However, the first and second flow passages 91, 92, 121, 122 may be replaced by a pair of flow passages 143 formed according to a sixth embodiment of this invention shown in FIGS. 21 and 22 corresponding to FIGS. 11 and 13. The flow passages 143 are defined by respective two opposed inner side surfaces 144 of a platen and respective outer side surfaces 142*a* of a bar-like member 142. In the platen of this sixth embodiment, the groove has an upper portion 141 which extends in the horizontal direction and has a transverse cross sectional shape which is held constant in the longitudinal direction. However, the bar-like member 142 has a transverse cross sectional surface area which gradually increases in the direction of flow of the ink, so that a gap formed between the upper portion 141 and the bar-like member 142 gradually decreases in the ink flow direction, whereby the transverse cross sectional surface area of the flow passages 143 gradually decreases in the ink flow direction. The gradual decrease of the cross sectional surface area of the flow passages 143 assures a gradual increase of the capillarity action of the flow passages 143 in the direction of the ink flow, permitting a smooth flow of the ink. That is, the capillarity force acting on the ink flowing through the flow passages 143 gradually increases in the ink flow direction.

Seventh Embodiment

Figure 23:
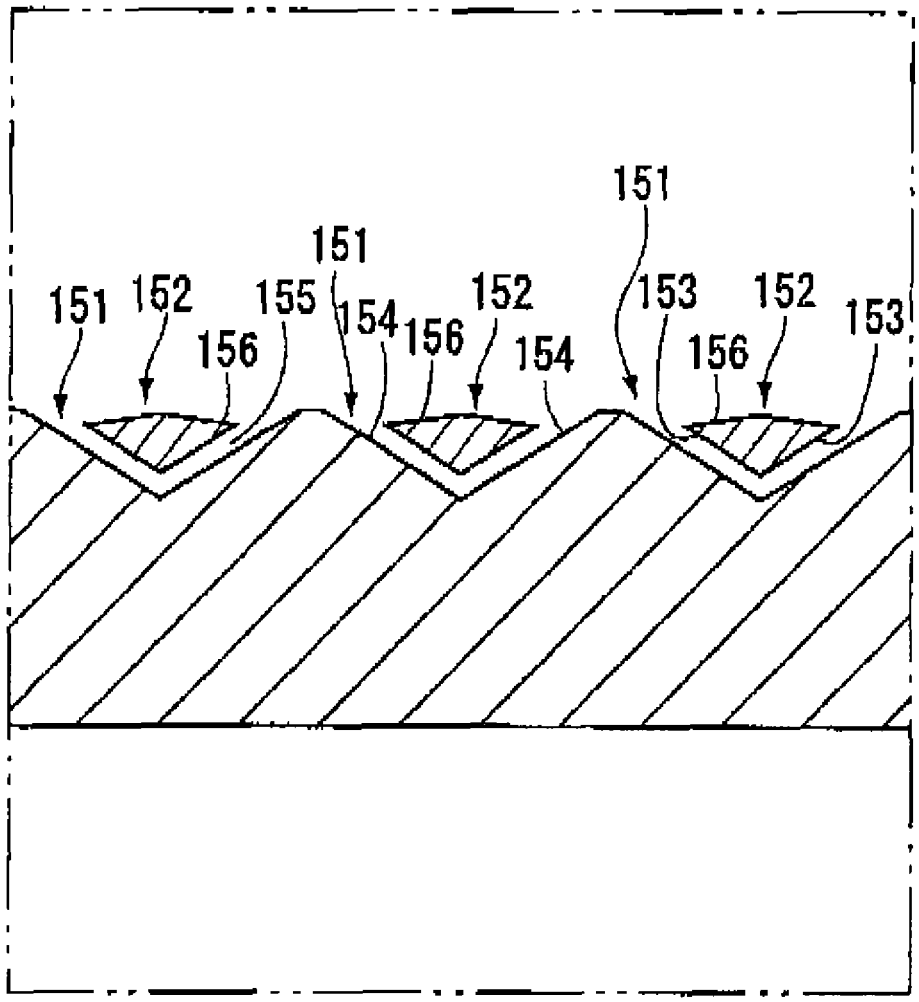
FIGS. 23-25 are enlarged views corresponding to those of FIGS. 11, 13 and 15, showing respective parts of a platen according to a seventh embodiment of this invention.
Figure 24:
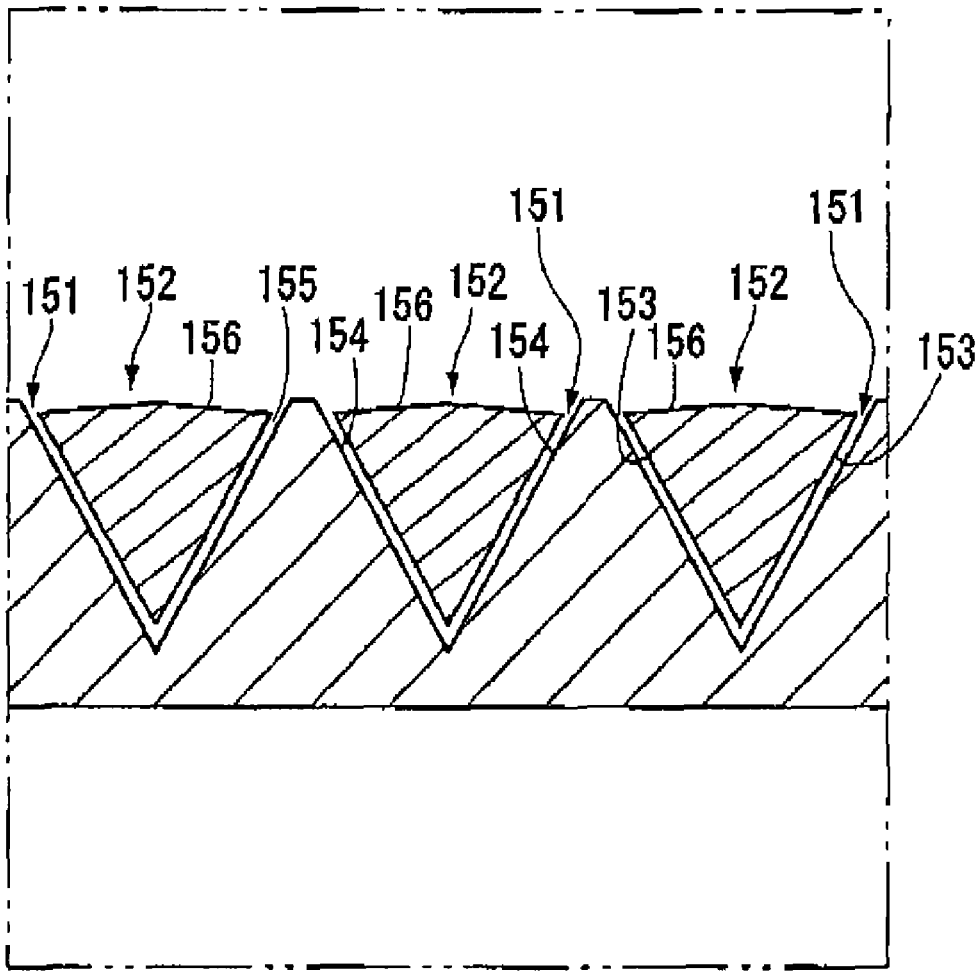
Figure 25:
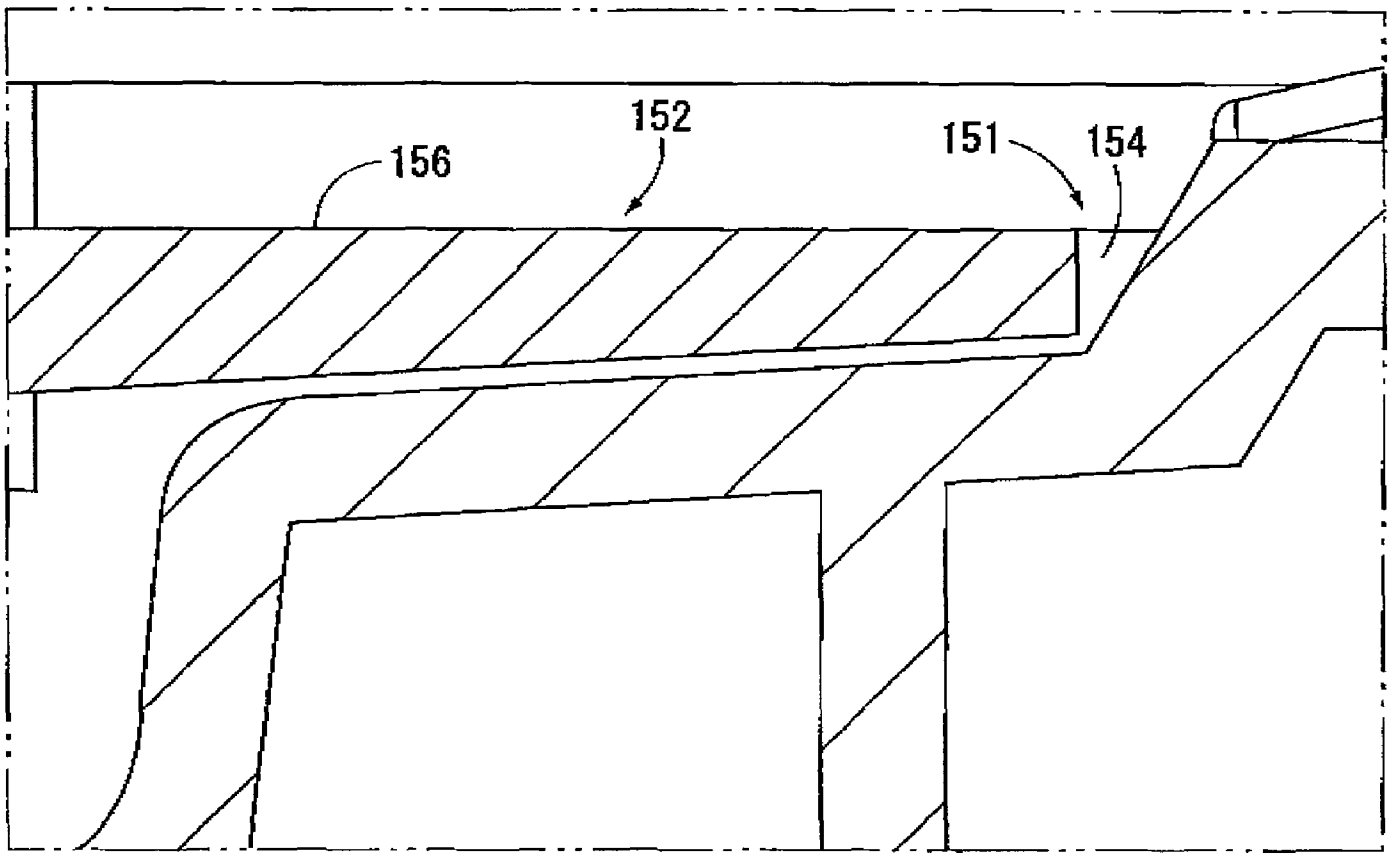

In the preceding embodiments, the transverse cross sectional shape and surface area of the upper portion 63, 111, 141 of the groove 62, 110 are held constant in the longitudinal direction of the upper portion 63, 111, 141. However, the groove may have an upper portion 151 the transverse cross sectional shape and surface area of which change in the longitudinal direction, as shown in FIGS. 23-25 showing a seventh embodiment of the present invention. FIGS. 23-25 are enlarged views corresponding to those of FIGS. 11, 13 and 15. The upper portion 151 of the groove has a width at the upper open end, which is held constant in the longitudinal direction, but has a depth which gradually increases in the direction of the ink flow. A bar-like member 152 is accommodated in the groove defined by two opposed inner side surfaces 154 of the main body of the platen. The bar-like member 152 has two outer side surfaces 153 which extend substantially in parallel with the inner side surfaces 154. However, gaps 155 which are formed between the side surfaces 153 and the inner side surfaces 154 and which function as a pair of flow passages 155 gradually decrease in transverse cross sectional surface area in the ink flow direction. Accordingly, the capillarity force acting on the ink flowing through the flow passages 155 gradually increases in the ink flow direction. This gradual increase of the capillarity force and the gradual increase of the depth of the upper portion 151 cooperate to provide a synergistic effect assuring a smooth flow in the ink through the flow passages 155.

In the seventh embodiment described above wherein the transverse cross sectional surface area of the flow passages 155 is larger at a relatively upstream part of the upper portion 151 than at a relatively downstream part of the upper portion 151, the width of parts of the inner side surfaces 154 which are not covered by the bar-like member 152 is comparatively large at the relatively upstream part. Accordingly, a distance between the printing head 39 and those parts of the inner side surfaces 154 is larger than a distance between the printing head 39 and an upper surface 156 of the bar-like member 152, at the relatively upstream part of the flow passages 155. Since the angle of inclination of the inner side surfaces 154 at the relatively upstream part is relatively small, however, the relatively large width of the above-indicated non-covered parts of the inner side surfaces 154 at the relatively upstream part of the upper portion 151 does not cause a significant increase of the distance between the printing head 39 and the above-indicated non-covered parts of the inner side surfaces 154, whereby the generation of an ink mist can be effectively avoided.

In the preceding embodiments, the grooves 62, 110 is V-shaped in the transverse cross sectional plane perpendicular to the direction of flow of the ink through the grooves 62, 100. However, the grooves formed in the platen according to the present invention may have any other shape in the transverse cross section, for instance, a rectangular or semicircular shape.

What is claimed is:

1. An ink-jet printing platen provided in an ink-jet printing device operable to eject droplets of an ink toward a surface of a recording medium for thereby performing a printing operation on the recording medium, the ink jet printing platen being disposed to support the recording medium in an upward direction, the ink jet printing platen comprising:

a main body having a plurality of grooves which are arranged in a direction perpendicular to the direction of extension of the grooves and through which the ink flows; and a plurality of elongated members accommodated in the respective grooves and extending along the respective grooves, wherein the main body has an inner surface which defines each of the plurality of grooves and which cooperates with the corresponding elongated member to define therebetween a gap extending in a longitudinal direction of each groove.

2. The ink jet printing platen according to claim 1, comprising at least one of the following technical features: each of the plurality of grooves being formed such that the groove has a height less at one end thereof than at the other end; the gap being shaped such that a capillarity force acting on the ink existing in the gap increases in a direction from said one end toward the other end; and the groove being held at said one end in contact with an ink absorber which absorbs the ink.

3. The ink jet printing platen according to claim 1, wherein the inner surface of the main body comprises a pair of inner side surfaces opposed to each other, and each of the plurality of elongated members has a pair of outer side surfaces which are held in an opposed relationship with the pair of inner side surfaces, respectively, to define gap including (i) at least one pair of first flow passages extending in a direction of depth of the corresponding groove, and (ii) a second flow passage extending in a direction of extension of the corresponding groove.

4. The ink jet printing platen according to claim 3, wherein the second flow passage has a surface area as viewed in a transverse cross sectional plane perpendicular to a direction of flow of the ink through the second flow passage, which surface area gradually decreases as the second flow passage extends in the direction of flow of the ink.

5. The ink-jet printing platen according to claim 4, wherein each of the plurality of elongated members has a surface area as viewed in said transverse cross sectional plane, which surface area gradually increases as the elongated member extends in the direction of extension of the corresponding groove, whereby the surface area of the second flow passage gradually decreases as the second flow passage extends in the direction of flow of the ink.

6. The ink jet printing platen according to claim 3, wherein each of the plurality of grooves has a depth which gradually increases as the groove extends in a direction of flow of the ink through the second flow passage.

7. The ink jet printing platen according to claim 3, wherein each of the plurality of grooves is V-shaped as viewed in a transverse cross sectional plane perpendicular to a direction of flow of the ink through the groove.

8. The ink jet printing platen according to claim 3, wherein each of the plurality of elongated members has a pair of slant surfaces which are inclined downwards toward said first flow passages, respectively.

9. The ink-jet printing platen according to claim 3, wherein each of the plurality of elongated members has protrusions which extend from the pair of outer side surfaces thereof and which are spaced from each other in a direction of extension of the elongated member, the protrusions being held in contact with the pair of inner side surfaces of the main body such that the elongated member is positioned in place within the corresponding groove, so as to define the first and second flow passages.

10. The ink-jet printing platen according to claim 3, wherein each of the plurality of elongated members has recesses formed in the pair of outer side surfaces thereof which are spaced from each other in a direction of extension of the elongated member, the pair of outer side surfaces being held in contact with the pair of inner side surfaces of the main body such that the elongated member is positioned in place within the corresponding groove and such that the pair of inner side surfaces cooperate with the recesses to define the first flow passages.

11. The ink jet printing platen according to claim 1, further comprising an ink absorber disposed on a downstream side of the plurality of grooves as viewed in a direction of flow of the ink through the second flow passage, the ink absorber absorbing and retaining the ink therein.

12. The ink jet printing platen according to claim 1, having two upwardly projecting medium-support portions which are disposed on respective opposite sides of said each groove as viewed in a direction of extension of the groove.

13. The ink jet printing platen according to claim 12, further comprising a covering member covering at least a part of the main body, and wherein the main body has one of the two upwardly projecting medium-support portions, while the covering member has the other of the two upwardly projecting medium-support portions.

14. The ink jet printing platen according to claim 13, wherein one of the two upwardly projecting medium-support portions includes a plurality of ribs arranged in a direction perpendicular to the direction of extension of said each groove, while the other of the two upwardly projecting medium-support portions includes a projection extending in the direction perpendicular to the direction of extension of the groove.

15. The ink jet printing platen according to claim 1, wherein said second flow passage is partially defined by a pair of inner side surfaces, and a bottom surface having a height which gradually increases in the direction of extension of the corresponding groove.

16. An ink jet printing device comprising:

the ink-jet printing platen defined in claim 1;

a feeding mechanism for feeding a recording medium onto the ink-jet printing platen; and a printing head disposed in an opposed relationship with the ink jet printing platen and configured to eject droplets of an ink.

17. An ink jet printing platen provided in an ink-jet printing device operable to eject droplets of an ink toward a surface of a recording medium for thereby performing a printing operation on the recording medium, the ink jet printing platen being disposed to support the recording medium, the ink jet printing platen comprising:

a main body having a plurality of grooves through which the ink flows; and a covering member having a plurality of elongated members accommodated in the respective grooves and extended along the respective grooves, the covering member including a covering portion covering at least a part of the main body, and a comb portion having the plurality of elongated members formed in a comb pattern, wherein the main body has an inner surface which defines each of the plurality of grooves and which cooperates with the corresponding elongated member to define therebetween a gap extending in a longitudinal direction of said each groove.

18. An inkjet printing platen, comprising;

a main body having a plurality of grooves; and a plurality of elongated members accommodated in the respective grooves, wherein each of the plurality of grooves and a corresponding one of the plurality of elongated members define therebetween a gap extending in a longitudinal direction of said groove.

* * * * *